United States Patent [19]

Cooper et al.

[11] Patent Number: 4,767,350

[45] Date of Patent: Aug. 30, 1988

[54] RECEPTACLE AND PLUG ASSEMBLY

[75] Inventors: Ralph M. Cooper, Clemmons; Earl J. Hayes, Advance, both of N.C.; Keith R. Denlinger, Lancaster, Pa.

[73] Assignee: AMP Incorporated, Harrisburg, Pa.

[21] Appl. No.: 876,549

[22] Filed: Jun. 20, 1986

[51] Int. Cl.[4] ..... H01R 13/74

[52] U.S. Cl. ..... 439/271; 439/362; 439/382; 439/533; 439/559; 439/748; 439/851

[58] Field of Search ..... 339/17 LC, 220 R, 221 R, 339/221 M, 217 S, 252 R, 252 P, 94 R, 94 A, 94 C, 94 M, 206 R, 206 P, 207 R, 207 S, 126 R, 126 RS, 132 R, 132 B, 93 R, 93 C, 176 M, 92 R, 92 M, 65

[56] References Cited

U.S. PATENT DOCUMENTS

| | | | |
|---|---|---|---|
| 2,987,693 | 6/1961 | Wamsley | 339/65 |
| 3,336,569 | 8/1967 | Nava | 339/94 M |
| 3,351,894 | 11/1967 | Kinkaid | 339/217 S |
| 3,530,428 | 9/1970 | Zak | 339/217 S |
| 3,538,489 | 11/1970 | Bennett et al. | 339/217 S |
| 3,763,460 | 10/1973 | Hatschek et al. | 339/89 M |
| 4,181,391 | 1/1980 | Kilsdonk | 339/92 M |
| 4,186,988 | 2/1980 | Kobler | 339/176 MP |
| 4,193,654 | 3/1980 | Hughes et al. | 339/17 LC |
| 4,225,209 | 9/1980 | Hughes | 339/126 R |
| 4,252,399 | 2/1981 | Bauerle | 339/217 S |
| 4,407,559 | 10/1983 | Meyer | 339/126 R |
| 4,491,376 | 1/1985 | Gladd et al. | 339/17 LC |
| 4,589,721 | 5/1986 | Sedig et al. | 339/217 S |
| 4,634,203 | 1/1987 | Noyes | 339/91 R |

*Primary Examiner*—John McQuade
*Attorney, Agent, or Firm*—Eric J. Groen

[57] ABSTRACT

An electrical connector for interconnecting a plurality of signals comprises an assembly of a plug and receptacle. The plug includes a housing member having a cavity at its forward end defined by a peripheral wall and a cavity wall, and a rear wall. The housing further includes contact receiving apertures extending between the cavity wall and the rear wall. An insert is locked in place in the forward cavity, the adjacent wall of the insert having standoff feet to define a gap between the cavity wall and insert wall. The insert has apertures in alignment with the apertures in the housing. The apertures within the insert include a shoulder facing the rear wall of the insert. A contact insertable into the apertures in the housing and insert has a lance which is locatable in the gap between the cavity wall and insert wall to lock the contact in place. The receptacle has a right-angled configuration having pins extending from a mounting face for interconnection to a printed circuit board. A second face is mountable to a bulkhead and has three rows of pins mounted in a cavity recessed from the second mounting face for interconnection to a matable plug having socket contacts. The contacts within the receptacle are disposed in three tiers, the contacts being bent around mandrels to form the right-angled bend. Below the mandrels is a contact locating plate having contact receiving slots in line with the contacts. The upper and lower row of contacts are laterally aligned with each other and with a first contact receiving slot. The first slot has two widths, and has a rib extending down along the edges of the slot. When the contacts are placed in the slot, the ribs interferingly hold the contacts in place, the second row of terminals is also aligned with a contact receiving slot having ribs for interferingly locking the second row of terminals in place.

21 Claims, 18 Drawing Sheets

544
400
560
500
548
550
562
466
560
500
502
490
410
300
308
314
302
18
34
308
314
36
32
2
14
110

Fig. 8
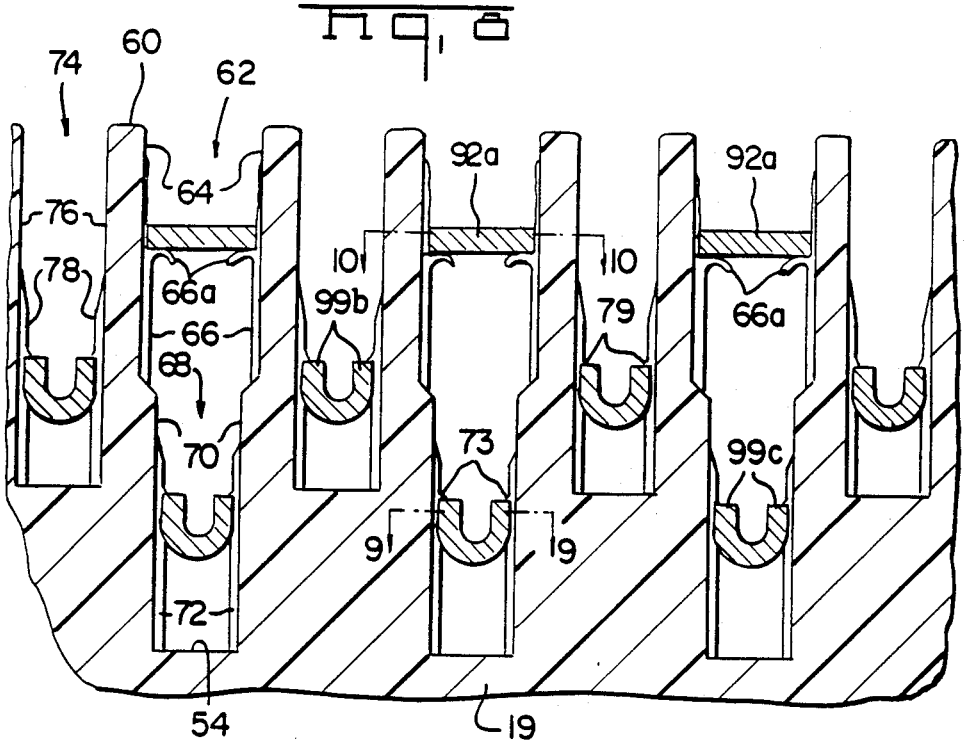
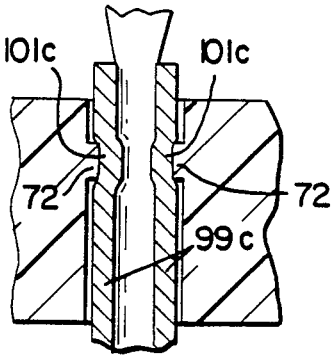
Fig. 9
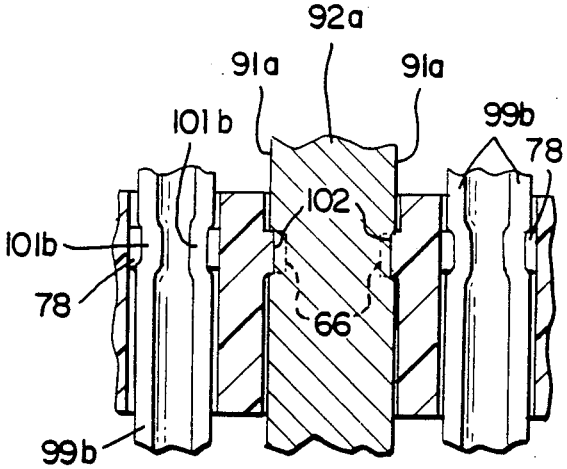
Fig. 10

460
472
474
14A
490
498
502
500
498
478
474
470
474
14A
492

466
468
469
480
481
488
460
492
484
482
486
476
474
476
490
478
496
498
470
446
444
444
454
436
456
456
410
438
434
430
442
432

RECEPTACLE AND PLUG ASSEMBLY

BACKGROUND OF THE INVENTION

1. Field of the Invention

The instant invention relates to a high density interconnect between a printed circuit board and a multiconductor cable having socket contacts within a mating plug. The connector has a right-angled connection to the printed circuit board and pin contacts matable with socket contacts in the mating plug assembly.

2. Prior Art

There is disclosed in U.S. Pat. No. 3,351,894 to Kinkaid a right-angled connector for mounting on a printed circuit board and for interconnection to a matable plug. This connector however doesn't allow for high-density interconnections in that there is only a single row of contacts mounted to the printed circuit board. If the contacts cannot be stacked vertically from the printed circuit board, more real estate on the printed circuit board is required for interconnections.

U.S. Pat. No. 4,186,988 to Kobler FIG. 10, and U.S. Pat. No. 4,193,654 FIG. 3 and U.S. Pat. No. 4,225,209 FIG. 1, to Hughes shows an alternate design for staggering contacts in order to increase the use of printed circuit board space.

U.S. Pat. No. 4,491,376 to Gladd et al. shows a right-angled mount connector for mounting on a printed circuit board having solid pin contacts wherein two pins are laterally aligned within the connector, one above the other, each pin then bent downwardly for interconnection to the printed circuit board. In Gladd however, the pins have lateral projections which skive the interior cavity walls upon insertion, and embed within the walls. Thus, the pin contacts have no means for being accurately placed within the cavities. Also, once in place, it is difficult to maintain the pin contacts in a fixed axial position, as the contacts have no positive stops.

In Gladd et al, the pin contacts are bent downwardly into longitudinal slots for receipt into detents. Using detents for the placement of the pin contacts allows the contacts to move with the respective slots, becoming misaligned with respect to the printed circuit board.

There is disclosed in U.S. Pat. No. 3,530,428 to Zak an electrical connector having a locking lance for locking two mating electrical terminals 104, 106 within housing halves 100, 102, respectively. However in Zak, the housing halves are not two piece, therefore because of molding limitations the slots 50, 52 can only be one diameter or increasing in diameter as the slot progresses outwardly towards the front face of the housings. To prevent the terminals from being pulled out, a fixed tab 118, 124 is includable on each of the terminals, lying outside of the envelope of the terminal body portion which rests on internal tapered seats 144, 156 within the cavities. This type of terminal could not be utilized in an application where the terminal must be inserted through a sealing grommet, as the insertion of the terminal would tear the grommet apertures upon insertion therethrough.

There is disclosed in U.S. Pat. No. 4,252,399 a socket contact 1 locked within a two piece housing, although to prevent the terminal from being pulled outwardly through the front face of the housing, a crimped bead 16 in includable on the rearward portion of the contact. Therefore, this contact could not be used in an application where sealing is required as the bead 16 would tear or stretch a sealing aperture through which the terminal is being placed. Furthermore, the socket ends 7,8 could not be utilized to bear against the backside of the forward mounting plate, as the force against the backside surface would be detrimental to the effectiveness of the contacts' resiliency.

SUMMARY OF THE INVENTION

The subject invention relates to a high density connector assembly including a receptacle for right angle mounting of a printed circuit board, and a two-piece plug assembly. The plug and receptacle are mountable to opposite sides of a bulkhead wall for interconnection therethrough. The receptacle and plug are securely mounted to each other to vibrate as a unit.

The receptacle has a housing with a cavity for receiving a plurality of contacts disposed in parallel rows. The cavity of the housing is defined by a back wall having apertures extending through the housing, the apertures for receiving the contacts in the parallel rows. At least two rows of the contacts are aligned laterally. The apertures extend from the back wall and are contiguous with channels formed in mandrels extending from the rearward side of the housing. Positioned between the channels and the apertures are back surfaces, transverse to the direction of the apertures. The mandrels are used for bending the contacts therearound, an upper mandrel extending further outward from the back wall than a lower mandrel, axially positioning the upper contact away from the lower contacts. A lower row of apertures extend into and through the cavity back wall and are bent downwardly lying substantially flush against the back wall.

The contacts are stamped and formed having a pin end, an intermediate shank portion and an end portion formed by two upstanding arms formed in a U-shape. Intermediate the pin end and the shank portion is located an upstanding portion to contact and abut the back surface in the channel to accurately position the contact axially in the aperture.

Extending from the back wall of the housing beneath the upper and lower mandrels is a contact locating plate having slots in lateral alignment with the contacts. The upper and lower contacts are laterally aligned and are located in one slot which extends from the end of the locating wall to the back wall of the housing. A laterally offset slot is provided to locate the middle row of contacts.

The subject invention also includes a two-piece plug housing including an insert and a housing member having an insert receiving cavity. The cavity is defined by a forward surface and has contact receiving apertures extending from the forward surface to a rearward section of the plug housing.

The insert includes a forwad face, a rearward face, and standoff feet extending from the rearward face. The insert is insertable into the insert receiving cavity and lockable in place therein, the standoff feet of the insert abutting the forward surface of the insert cavity providing a gap therebetween. The insert further includes apertures extending from the front through the rear face in alignment with the apertures in the plug housing. The apertures in the insert include a shoulder facing towards the rearward face defined by a reduced diameter of the aperture at the forward face.

The instant invention further includes a socket contact insertable through the rearward portion of the plug housing and into the aperture of the insert. The contact comprises a band portion at the forward end and a barrel portion, with a constricted portion extending therebetween. The contact further includes a lance struck from the barrel portion and extending through an opening on the opposite side of the barrel portion.

The invention also includes a sealing grommet installed in the rearward portion of the plug housing having apertures in alignment with the apertures in the insert and plug housing.

The socket contacts are installed by inserting a pin through the contact until the lance is within the envelope defined by the barrel portion of the contact. The contact is then insertable through the rearward portion of the plug housing until the contact forward end abuts the shoulder within the insert. The pin is then pulled away from the contact which allows the lance to bias the upward to its original position, out of the envelope defined by the contact barrel portion, and extends in the gap between the insert and plug housing, locking the contact in place.

BRIEF DESCRIPTION OF THE DRAWINGS

FIG. 3 is a perspective view of the receptacle cutaway to show the internal structure.

FIG. 8 is a view similar to that of FIG. 7 showing the three tiers of terminals in greater detail.

FIG. 9 is a cross-sectional view through lines 9—9 of FIG. 8.

FIG. 10 is a cross-sectional view through lines 10—10 of FIG. 8.

FIG. 13 is a cutaway view showing the internal structure of the insert.

FIG. 18 shows the plug and receptacle partially assembled and the plug radially deforming the seal.

FIG. 19A shows the cross section of the alternate embodiment completely assembled.

DETAILED DESCRIPTION OF THE PREFERRED EMBODIMENT

The subject matter disclosed herein is related to application Ser. No. 876,970, entitled "Printed Circuit Board Receptacle for Sealed Connector"; application Ser. No. 876,525, entitled "Sealed Plug for Interconnection to a Printed Circuit Board Receptacle"; and application Ser. No. 876,159, entitled "Sealing Member for Bulkhead Connector", all filed concurrently herewith. The above-mentioned applications are incorporated herein by reference.

Figure 1:
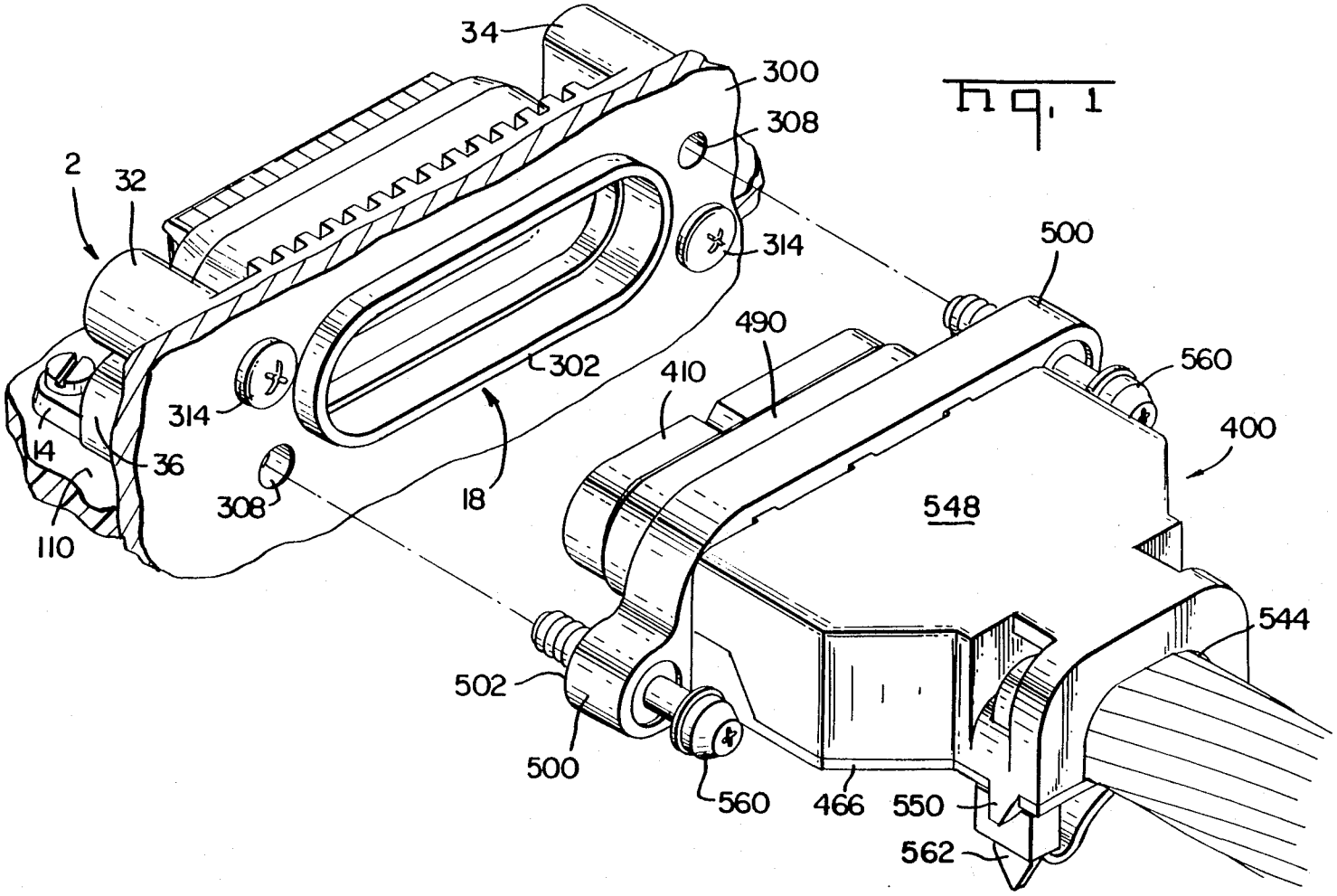
FIG. 1 is a perspective view of the preferred embodiment of the receptacle and plug assembly of the instant invention.

Referring to FIG. 1, the subject connector 2 is shown mounted to a bulkhead 300, such as a sealed "black box" for use in automotive controls. The connector 2 can be totally enclosed within the black box except for the plug receiving cavity 18, which is left exposed for receiving the plug 400. The connector 2 is also shown in FIG. 1 as having a printed circuit board 110 attached to the connector, the connector 2 for interconnecting the circuitry on the printed circuit board 110 with the plug 400.

Figure 2:
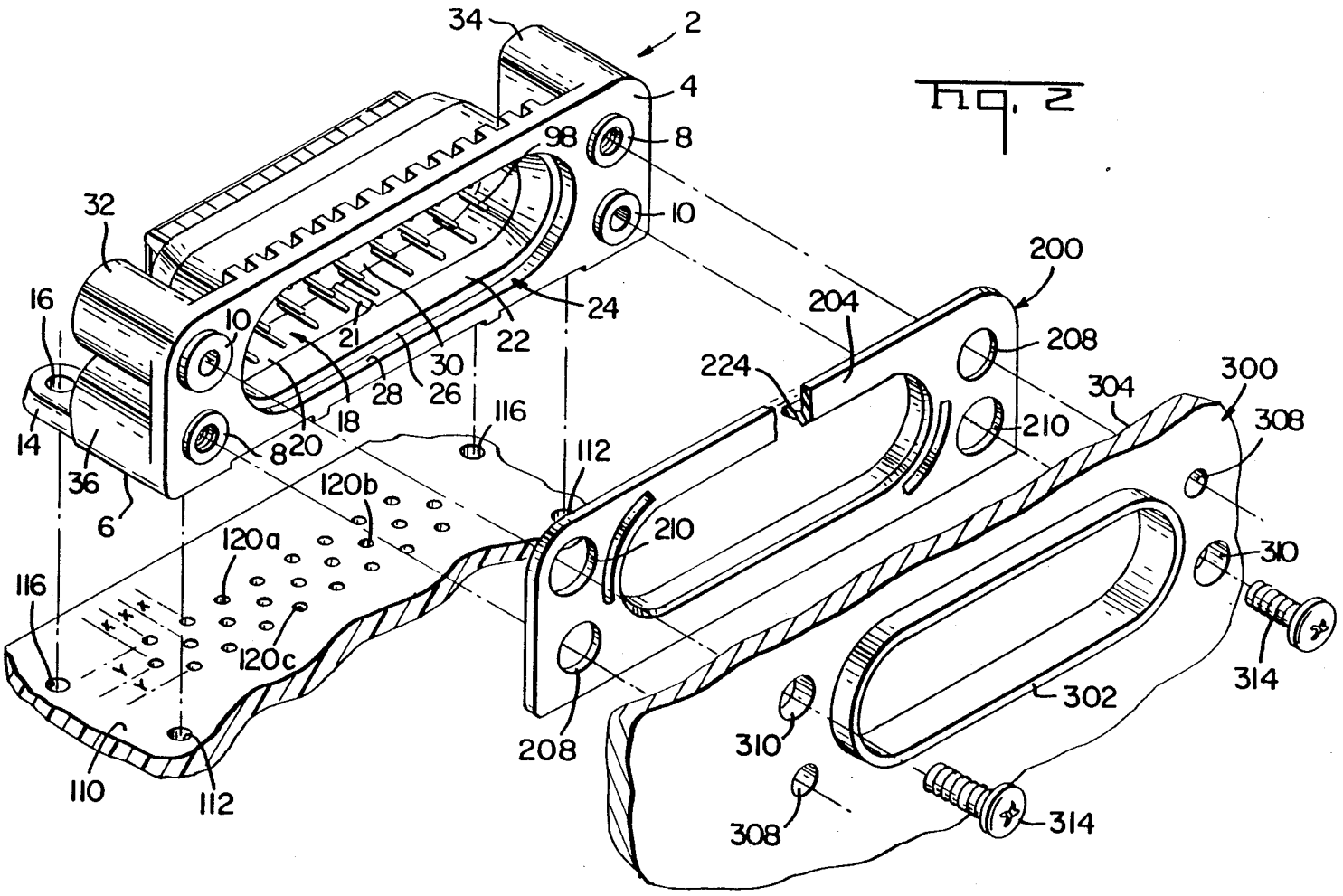
FIG. 2 is a perspective view of the receptacle exploded away from the grommet bulkhead.
Figure 1:
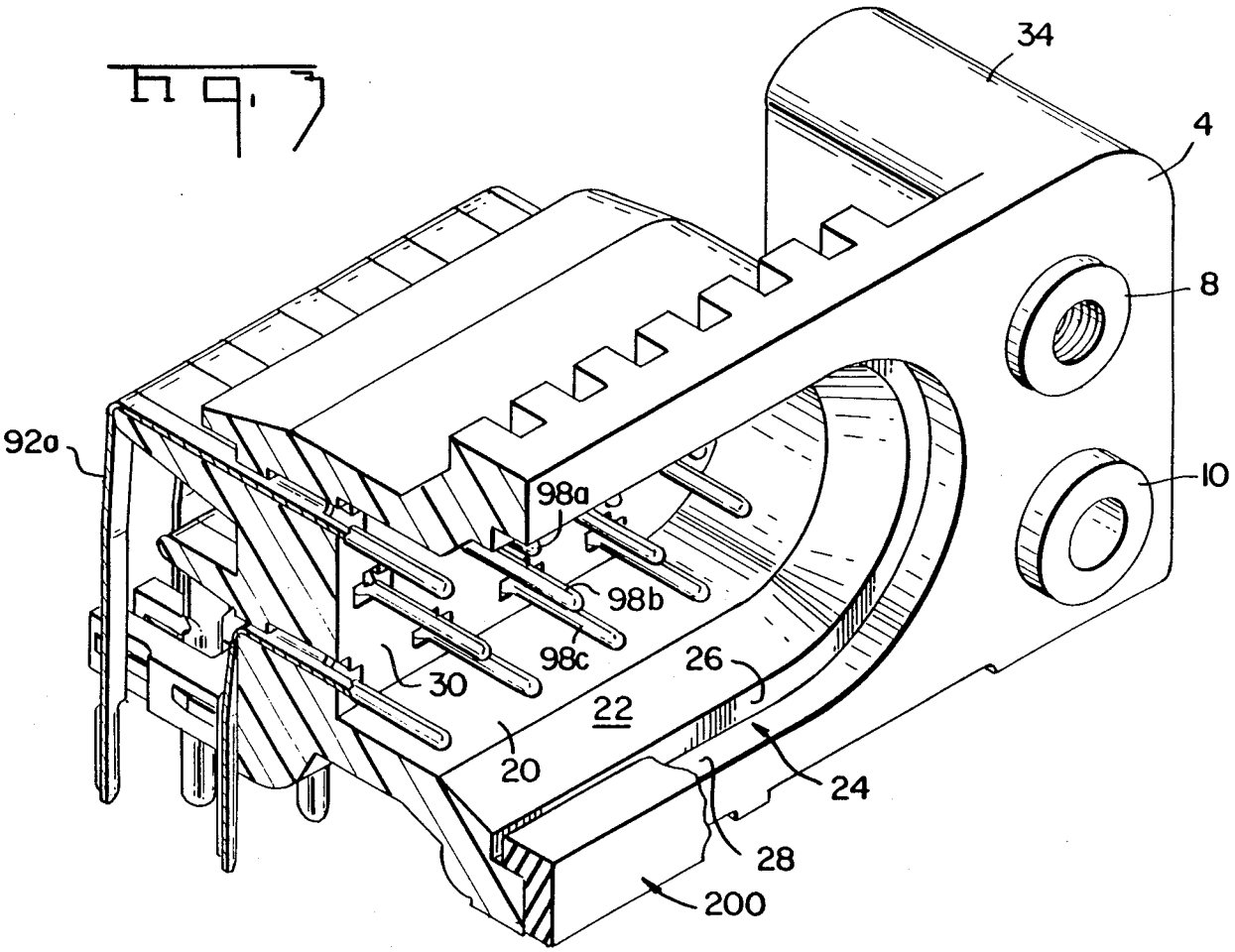

Referring more specifically to FIG. 2, connector 2 is shown in greater detail. The connector 2 has a front mating face 4 having a plug receiving cavity 18 therein. The cavity 18 is defined by a frustoconical surface 22, an oblong surface 20 and back surface 30. At the intersection of the cavity 18 and the front mating surface 4 is a gasket seat, shown generally as 24, which includes cylindrical surface 28 and back surface 26. The front mating surface 4 further includes alignment bosses 10 and threaded inserts 8. Extending from the back wall 30 forward along the oblong surface 20 is a polarizing lug 21.

Figures 4, 4A:
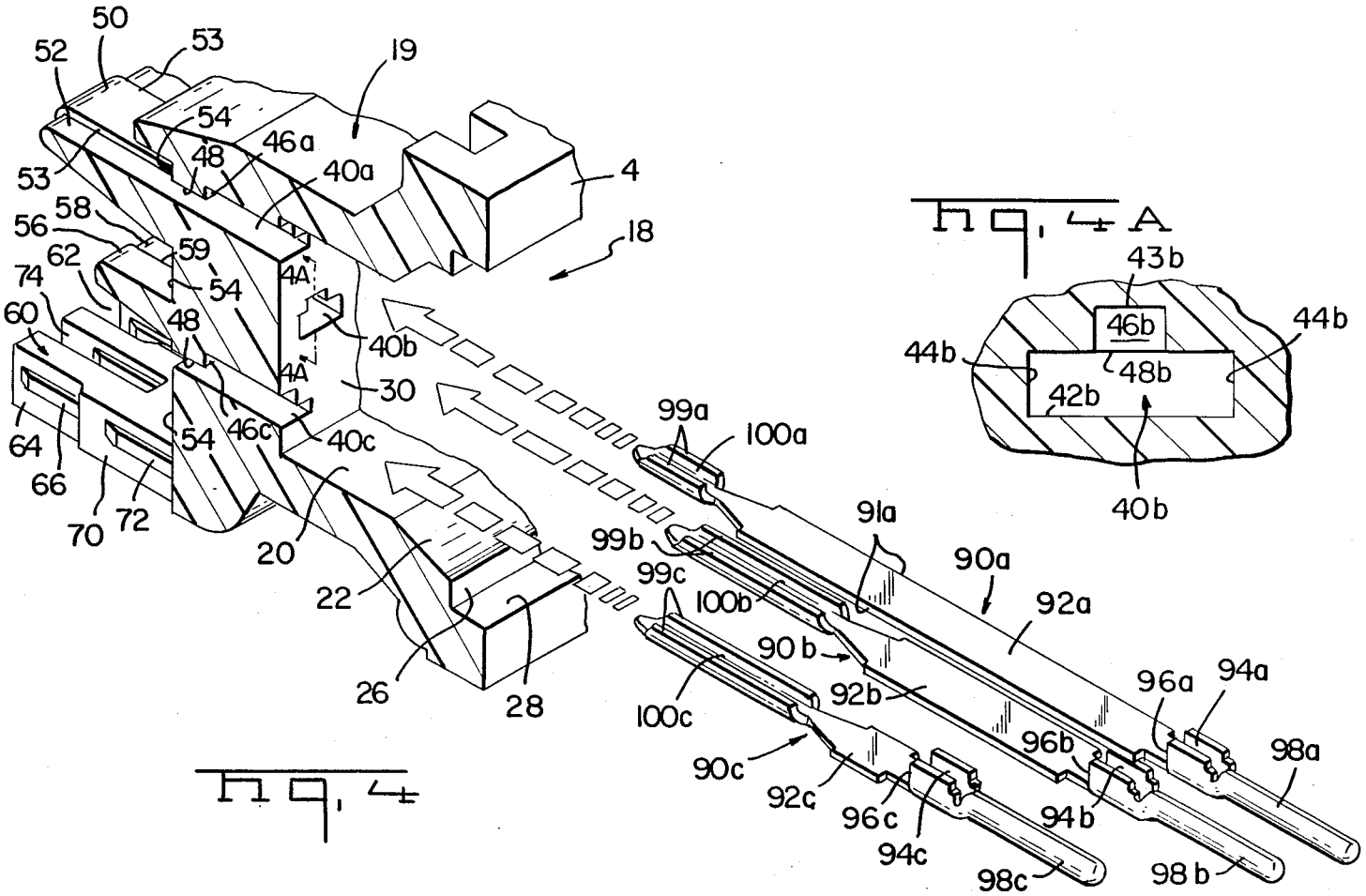
FIG. 4 is a perspective view similar to that of FIG. 3 showing the receptacle poised for receiving the respective terminals.
FIG. 4A is a cross-sectional view through lines 4A—4A of FIG. 4.

Still referring to FIG. 2, there is shown generally as 98 three rows of pin terminals. Referring more specifically to FIG. 4, the contacts 90A, 90B and 90C are shown in greater detail. It is apparent from FIG. 4 that each terminal differs somewhat from each other, although each contact has common constituent components. When referring to the contact or contact constituent components, reference will be made to numerals 90–100 generally, omitting the postscripts. When referring to a specific contact, reference will be made to numerals 90–100 adding the postscripts.

Contact 90A includes a long shank portion 92A having side edges 91A. On the forward end of contact 90A is contact end 100A formed by two bent upstanding arms 99A. At the pin end, contact 90A includes an upstanding portion 94A having a front edge 96A. The pin portion 98A is formed from the flat blank, the two flat edges rolled completely around into cylindrical configuration. Referring now to contact 90B, it can be seen that contact end 100B is formed like that of contact end 100A, yet contact end 100B is greater in length than that of contact end 100A. However, the shank portion 92B of contact 90B is shorter than that of contact 90A resulting in a decreased overall length with respect to contact 90A. Referring now to contact 90C, contact end 100C is substantially the same length as that of the contact end 100B, although the shank portion 92C is much shorter than 92B, resulting in contact 90C having a shorter overall length than that of contact 90B.

Still referring to FIG. 4, the internal structure of connector 2 is shown in greater detail. As shown in the cutaway, connector 2 has a central body portion 19, with a plurality of T-slots therein. There are three rows of T-slots, 40A, 40B and 40C, and postscripts A, B and C corresponding to the postscripts A, B and C of the contact 90, referring to the upper, center and lower positions of slots and contacts, respectively. When referring to the T-slots generally, the slots and constituent surfaces 40–48 will be referred to without using the postscripts A, B, and C. When referring to specific slots and constituent surfaces, reference will be made to numerals 40-48 adding the postscripts.

Each T-slot 40 begins at cavity back wall 30 and extends further rearwardly towards the outer surface 54. As shown in FIG. 4A, each T-slot has corresponding sidewalls 44, floor 42 and ceiling 43. As the T-slot 40 extends rearwardly, the T-portion of the slot ends at surface 46; the slot thereafter having a longitudinal cross section defined by a ceiling 48.

Adjacent the upper row of T-slots 40A, an upper ledge 50 extends from the back wall 54, the floor 42A of T-slot 40A contiguous and in alignment with terminal channel 52, and T-slot sidewalls 44B contiguous and in alignment with channel sidewalls 53, as shown in FIG. 4. Adjacent the middle row of T-slots 40B, an intermediate ledge 56 extends from the back wall 54, each floor 42B of T-slot 40B contiguous and in alignment with a terminal channel 58, and T-slot sidewalls 44B contiguous and in alignment with channel sidewalls 59, T-slot 40C has no ledge extending from the back wall 54, but rather terminates at the back wall 54.

As best shown in FIG. 4, each T-slot 40A is in substantial vertical alignment with a respective lower T-slot 40C, while for every aligned pair of T-slots 40A and 40C, there is a center T-slot 40B laterally staggered from 40A and 40C. Below the lower row of T-slots 40C and extending from the back wall 54 is a termination wall, shown generally as 60. Terminal wall 60 carries a plurality of laterally alternating termination slots 62 and 74. As best shown in FIGS. 4 and 8, each pair of aligned T-slots 40A and 40C is laterally aligned with termination slots 62, 68 while each center T-slot 40B is laterally aligned with termination slot 74.

As best shown in FIG. 8, each termination slot 62 is flanked by a pair of parallel opposed sidewalls 64 and extending downwardly, along each sidewall 64, is a rib 66. Termination slot 62 is laterally aligned with and in transition with a lower termination slot 68. The termination slot 68, is narrower in width than the termination slot 62, slot 68 being flanked by a pair of parallel opposed sidewalls 70 and extending downwardly along the sidewalls 70 are ribs 72.

Figure 7:
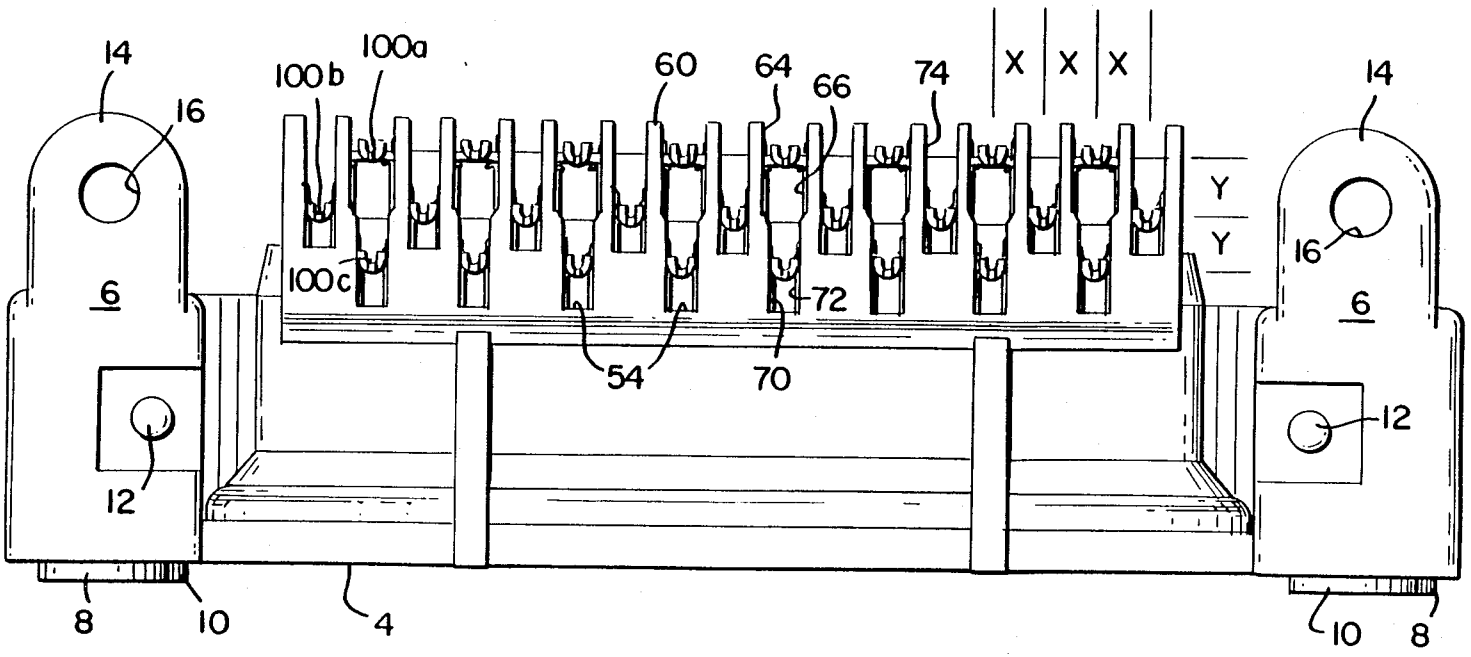
FIG. 7 is a plan view of the mounting surface of the receptacle.

Referring now to FIG. 7, the connector is shown having the mating face 4 on its side, with the mounting face 6 facing forward. Extending from the mounting face 6 are two alignment tabs 12. Also contiguous with mounting face 6 and planar thereto are mounting feet 14, having mounting holes 16 therein.

Although not part of the instant invention, FIG. 2 shows a printed circuit board 110 having two mounting holes 116 and two alignment holes 112 extending into and through the board 110. The printed circuit board 110 further includes three rows of circuit holes 120A, 120B and 120C, respectively.

Also shown in FIG. 2, but not part of the instant invention, are a gasket 200 and a bulkhead 300. The gasket 200 comprises a flat facial portion 204 and an O-ring portion 224 extending from the flat portion 204. On each end of the gasket 200 is located an insert receiving hole 208 and a boss receiving hole 210. The bulkhead 300 includes a mating face 304, two holes 308 for receiving machine screws 560 (FIG. 1) and two holes 310 for receiving self-tapping screws 314. The bulkhead 300 further includes a cylindrical portion 302 extending outwardly and away from face 304, as shown in FIG. 2.

Figures 5, 6:
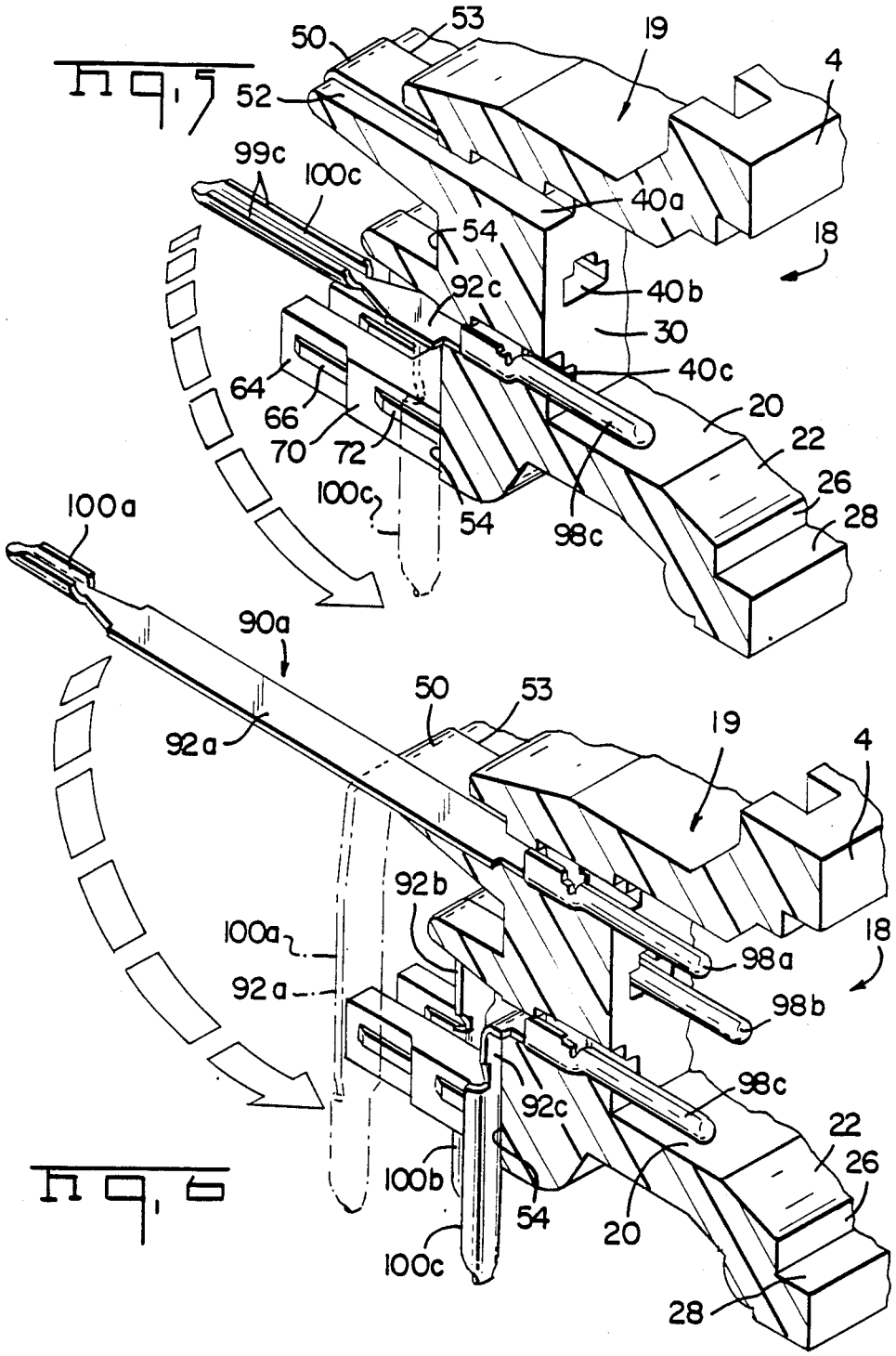
FIG. 5 is a view similar to that of FIG. 4 showing the lower terminal being bent into position.
FIG. 6 is a view similar to that of FIG. 4 showing the upper terminal being bent into position.

With reference now to FIG. 4, the three contact elements 90A, 90B and 90C are each shown poised for receipt in the respective T-slots 40A, 40B and 40C. The row of lower contact elements 90C are first installed in the T-slots 40C, the contact ends 100C fitting underneath the ceiling 48C, and the shank portion 92C lying on the floor portion 42C. The contact elements are inserted until the forward surface 96C of the upstanding portion 94C abuts the back edge 46C of slot 40C. The contact 90C is then bent downwardly, as shown in FIG. 5, until the upstanding arms 99C of terminal end 100C are forced between the ribs 72 in the lower terminal slot 68. When the terminal end is forced into the slot 68, the upstanding walls 99C are deformed inwardly slightly, crimping them at 101C, as shown in FIG. 9, assuring an adequate interference fit.

As the upstanding walls 99C are normally biased against ribs 72, and as theribs 72 are very narrow, the normal force of the upstanding walls 99C against ribs 72 causes the plastic in the ribs to flow over the top edges of the upstanding walls 99C to form portions 73, as shown in FIG. 8. The contact ends 99C are thereby positively seated within the slots 68 and against the ribs 72.

The second row of contacts 90B are then installed, each contact 90B in a respective T-slot 40B until the forward surface 96B abuts the back edge 46B. The contact 90B is then bent downwardly until the terminal end 100B is forced between the ribs 78 in termination slot 76. To assure an adequate interference fit, the upstanding arms 99B are deformed at 101B, as best shown in FIG. 10. The interaction of the upstanding walls 99B with the ribs 78 also forms a flowing portion of plastic 79 over the top edges of the upstanding walls 99B, as shown in FIG. 8.

The top row of terminals 90A is next inserted, each contact 90A laterally aligned with a respective lower contact 90C, as shown in FIG. 6. When the contact 90A is bent downwardly, and forced into the upper terminal slot 62, the edges 91A of the shank portion 92A shears a portion of the ribs 66 away from the sidewalls 64, leaving a curled end 66A. As the side edges 91A only shear off a portion of the ribs 66, a thin section of the rib 66 is first sheared on both sides, with an increasingly thicker section of sheared rib as the shank portions 92A continue downward into the slot 66, wedging the shank portion into the ribs 66 of slot 62. Furthermore, the side edges 91A of the shank portion 92A are slightly crimped inwardly at 102 (FIG. 10) assuring an adequate interference fit between the shank portion 92A and the ribs 66. Once the contact portions 90 are fit in their respective slots, the connector 2 may be mounted to a printed circuit board.

As stamped and formed, the distances between surfaces 96A, 96B and 96C, and the ends of pin portions 98A, 98B and 98C, respectively are all equal. Also, in each of the T-slots 40A, 40B and 40C, the distances from the back surfaces 46A, 46B and 46C to the cavity back wall 30, are also equal. Therefore when the contacts 90A, 90B and 90C are placed in their respective slots, the lengths of the pin portions 98A, 98B and 98C which protrude through the T-slots from the cavity back wall 30 are all equal. Furthermore, when shank portion 92A is bent downwardly around the mandrel 50, the contact 90A is fixed in an axial direction, that is, the contact cannot be further pushed axially into the T-slot 40A, nor can it back out of the T-slot 40A.

As the contacts 90B are staggered laterally of contacts 90A and 90C, and as the upper and lower contacts 90A and 90C are laterally aligned, the connector 2 provides for a high density connector for interconnection to a printed circuit board. As best shown in FIG. 2, the printed circut board 110 comprises three rows of circuit holes 120A, 120B and 120C, respectively. In order to properly align the terminal ends 100 with the respective circuit holes 120, the connector 2 includes two alignment bosses 12 extending downwardly from the mounting face 6, the bosses extending downwardly further than the terminal ends. Thus, when the connector is lowered towards the printed circuit board 110, the alignment bosses 12 are aligned with and begin their entry into alignment holes 112, before the terminal ends 100 reach the printed circuit board 110. Further lowering of the connector 2 onto the printed circuit board extends the terminal 100 ends into their respective circuit holes 120, the mounting face 6 of the connector 2 lowered onto the printed circuit board 110. As best shown in FIG. 18, the terminal ends 100 may then be soldered to the circuit 122 around the circuit hole 120, interconnecting the circuit traces 124 with the contacts 90.

Figure 11:
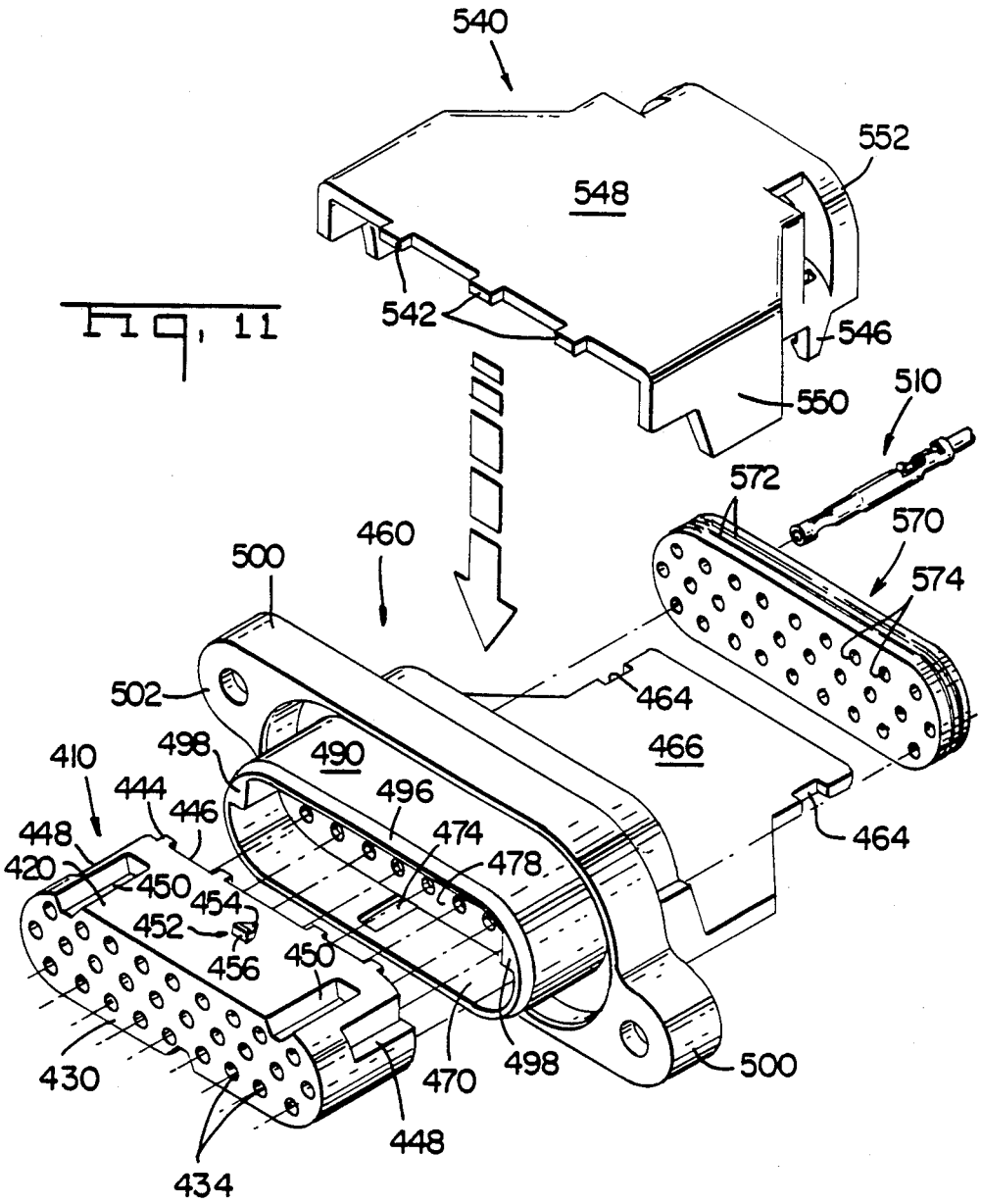
FIG. 11 shows the components of the plug assembly exploded away from the plug housing.

Referring more specifically to FIG. 11, the subject plug includes an insert 410, a plug housing 460 and a cover portion 540 and a plurality of socket contacts 510. Extending from the back surface 446 are a plurality of semicircular standoff feet 444. Located around the periphery of the insert 410 are two alignment channels 448, which extend from the back surface 446 and extend towards the front wall 430. Also extending around the periphery of the insert 410 are polarizing channels 450 extending from the front surface 430 extending rearwardly towards the back wall 446. Located on the top and bottom of surface 420 are two locking lugs 452, each lug having a ramp surface 454 and a locking surface 456.

Referring more specifically to FIG. 13, the insert 410 is shown in greater detail. The insert 410 is oval-shaped in nature having surface 420 peripherally surrounding the insert 410. Insert 410 further comprises a front wall 430 and a back wall 446. A contact receiving cavity 434 extends from the back face 446 through to the front face 430. The cavity 434 is defined by a contact lead-in portion 436, a straight portion 438, a pin-receiving diameter 442 and a pin-receiving chamfered surface 432. Shoulder 440 is defined by the decrease in diameter between straight section 438 and the pin-receiving diameter 442.

Figure 14:
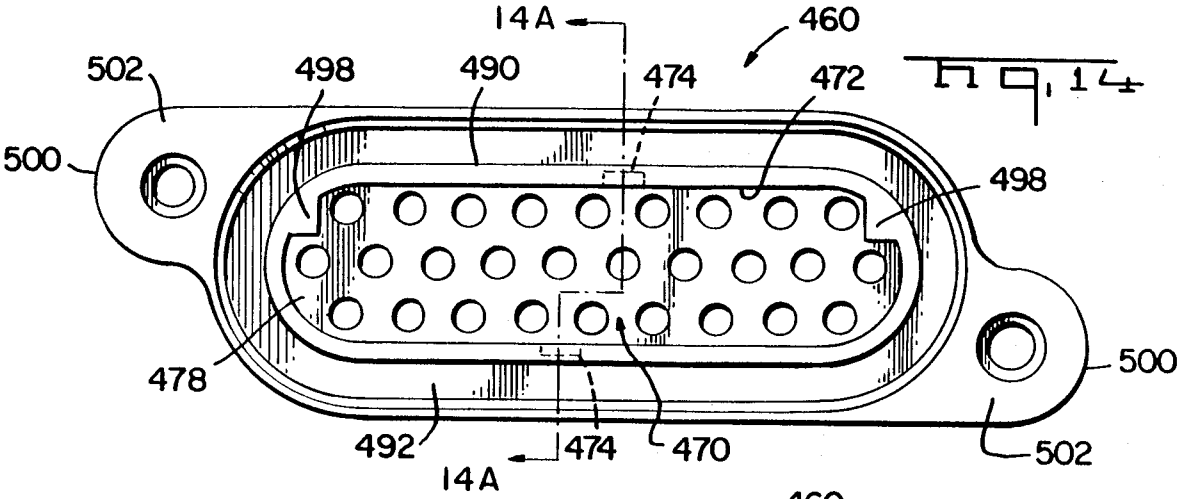
FIG. 14 is a front plan view of the plug housing.
Figure 14A:
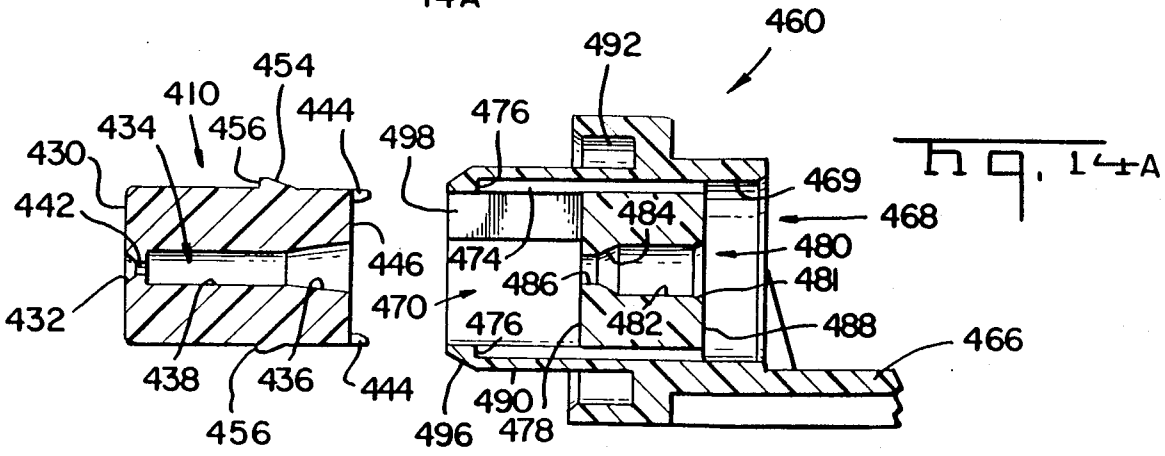
FIG. 14A is a cross-sectional view through lines 14A—14A of FIG. 14, including an exploded cross section of the insert.

Referring now to FIGS. 14 and 14A, the plug housing 460 is shown in greater detail. The housing 460 first comprises an insert receiving cavity 470 which is defined by oval-shaped interior surface 472 and a surface 478. Two alignment lugs 498 are located on either side of the cavity 470. The housing 460 further comprises a gasket-receiving cavity 468 defined by an oval-shaped peripheral surface 469 and a flat surface 488. A contact receiving aperture 480 extends from the flat surface 488 through to the surface 478, the aperture defined by contact lead-in section 481, a straight section 482, a lance lead-in section 484 and a bore 486. A locking lug channel 474 extends from the flat surface 488 to the forward portion of the housing 460, the termination of the channel being defined by a back surface 476.

Figure 11A:
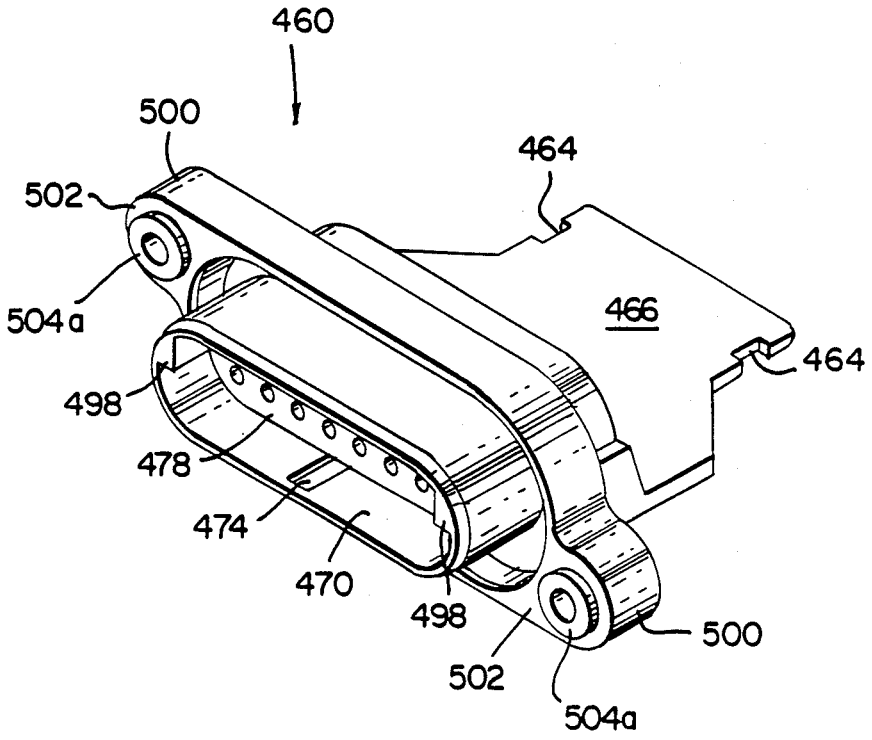

The exterior of the plug housing 460 includes a peripheral surface 490 and a plug lead-in surface 496. Also located on the exterior of the housing 460 is an O-ring receiving groove 492 which extends peripherally around the housing. As shown in FIG. 1, the preferred embodiment includes a planar mounting surface 502. Alternatively, the mounting surface of another embodiment includes mounting bosses 504A, as shown in FIG. 11A. Extending from the lower portion of the housing 460 is a wire-receiving surface 466 having a mounting lug 464 located on either side edge.

Figures 11, 12:
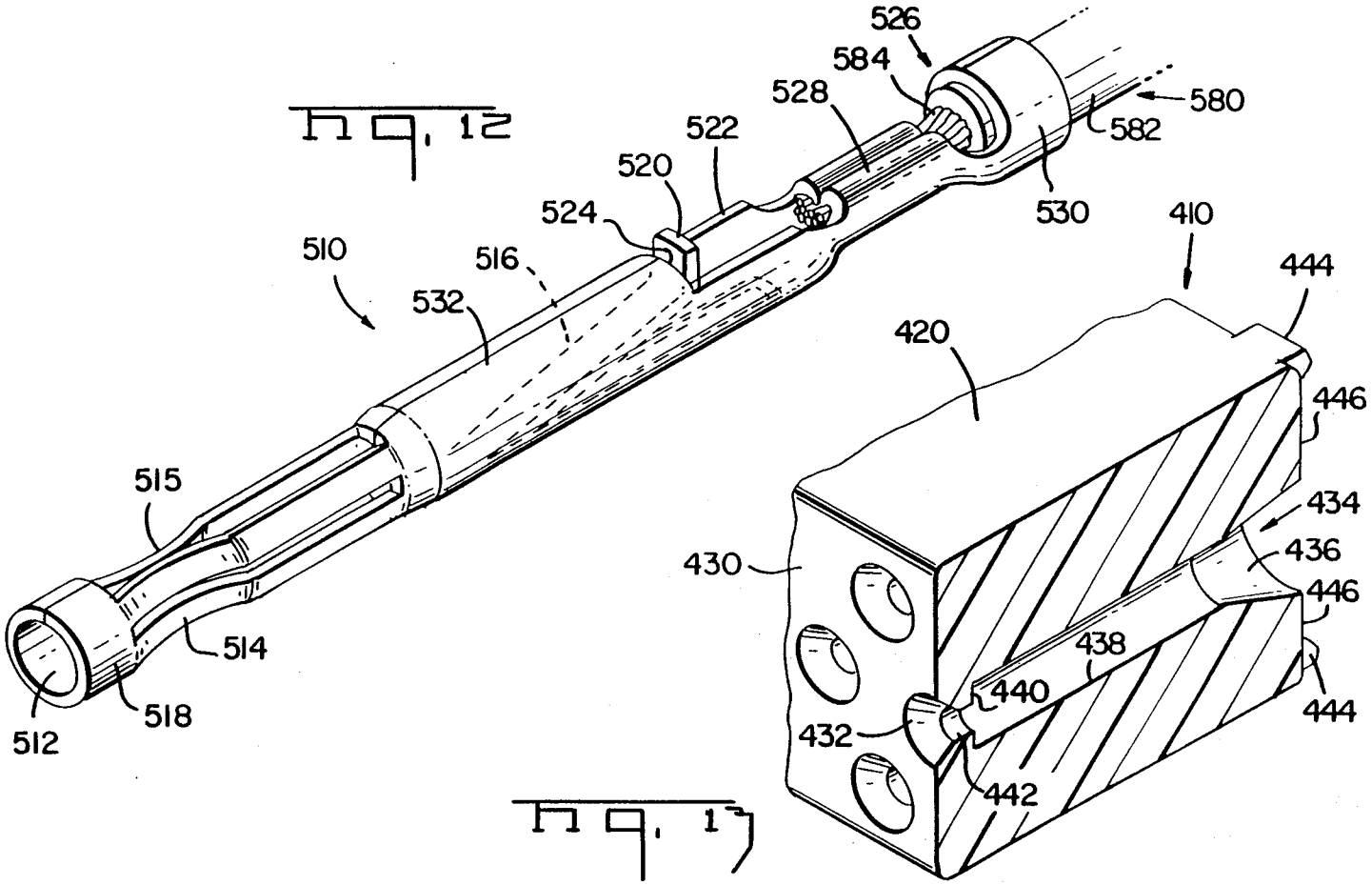
FIG. 12 is a perspective view of the socket contact.

Referring now to FIG. 12, the socket contact 510 is shown in greater detail. The socket contact 510 includes a socket end 518 having a pin-receiving opening 512 and a constricted portion 514. The constricted portion 514 comprises individual resilient beams 515, which are fixed at each end, by the socket end 518 at the forward end and by the contact barrel portion 532 at its rearward end. The contact 510 further includes a locking lance 516 struck from and extending upwardly from the lower portion of the contact 510 and has a lance end 520 bent upwardly which extends through an envelope defined by the barrel portion 532 of the contact 510 at lance opening 522. The lance end 520 extends outwardly through the lance opening 522 and is adjacent to a surface 524 of the contact 510. The socket contact 510 further comprises a wire terminating portion 526 including a conductor terminating area 528 and a strain relief section 530.

Referring again to FIG. 11, the cover 540 is shown as including top wall 548, sidewalls 550 and endwalls 552. Extending forwardly from the top wall 548 are latching tabs 542 and extending downwardly from the sidewalls 550 are latches 546. A wire bundle exit area 544 (FIG. 1) is located within the endwall 552.

Figure 16:
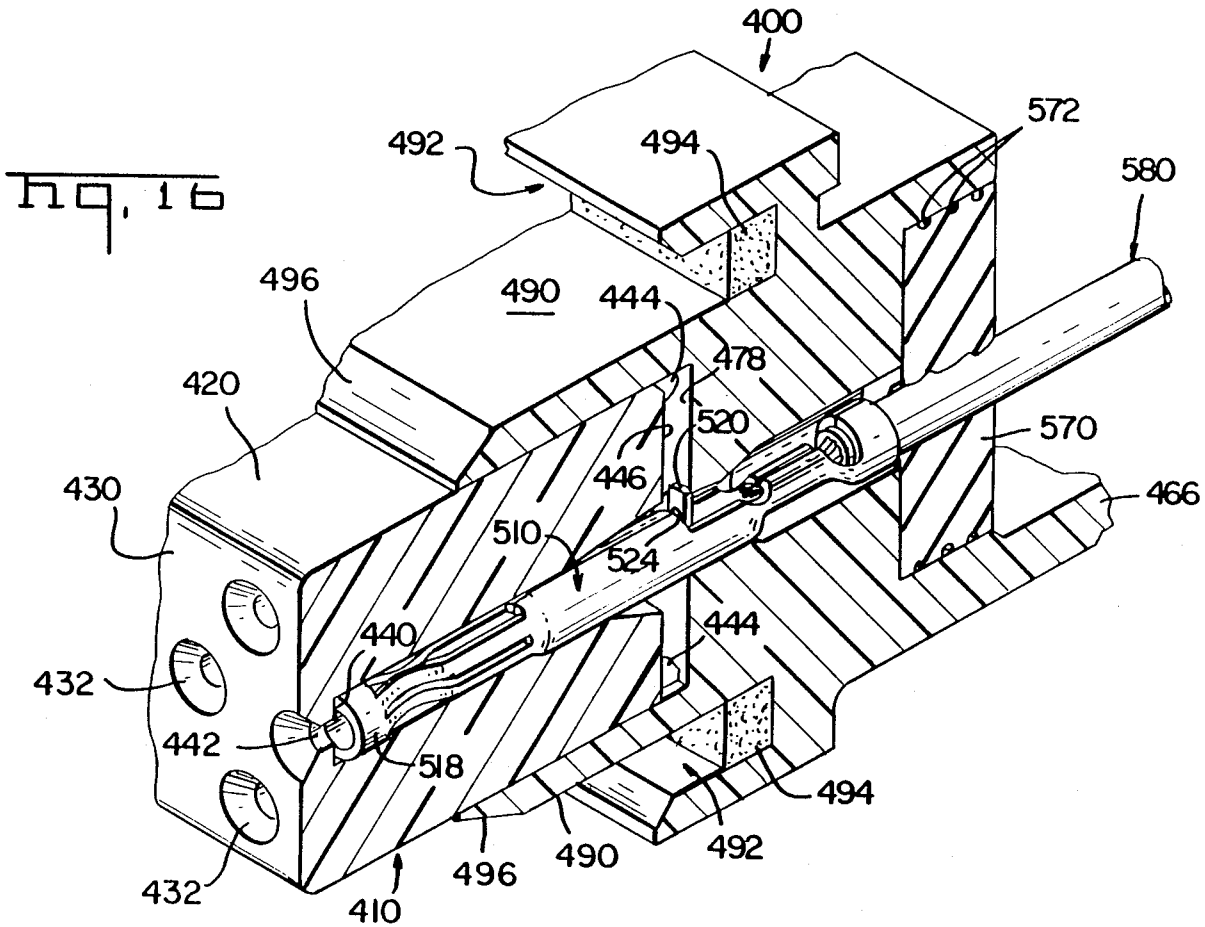
FIG. 16 is similar to that of FIG. 15 showing the contact locked in place.

To assemble the plug assembly, the insert 410 is placed in the insert-receiving cavity 470 of the plug housing 460, the alignment channels 448 mating with the respective alignment lugs 498, as shown in FIG. 11. The insert 410 is slid rearwardly in the cavity 470 until the standoff feet 444 contact the wall 478 of the plug housing 460. The insert 410 will then be locked within the cavity as an upper locking lug 452 is disposed in a upper channel 474 and a lower locking lug 452 is disposed in a lower channel 474, locking surfaces 456 against back surfaces 476, as shown in FIG. 14A. When the insert 410 is completely inserted in the cavity 470, a forward portion of the insert 410 protrudes through the cavity 470, as best shown in FIG. 16. Furthermore, when the insert 410 is completely backed up against the wall 478, a gap exists between the surface 446 and the surface 478, the gap being the height of the standoff feet 444. With the insert 410 in place, each contact-receiving cavity 434 in the insert 410 is axially aligned with a contact-receiving hole 480 in the plug housing. The grommet 470 is then placed in a rearward cavity 468, each aperture 574 in the grommet 570 in axial alignment with the contact-receiving holes 434 and 480, as shown in FIG. 16.

The socket contacts 510 are then prepared for insertion into the respective cavities. As shown in FIG. 12, each individual conductor 580 is prepared by removing a portion of the insulation 582 and exposing the conductor 584. The prepared wire 580 is then installed in the wire terminating portion 526, the conductor lying in the conductor terminating area 528 and the insulation portion 582 lying in the strain relief section 530. The conductor terminating section 528 is then crimped onto the conductor providing an adequate electrical connection, while the strain relief section 530 is folded around the insulation to provide a strain relief.

Figure 15:
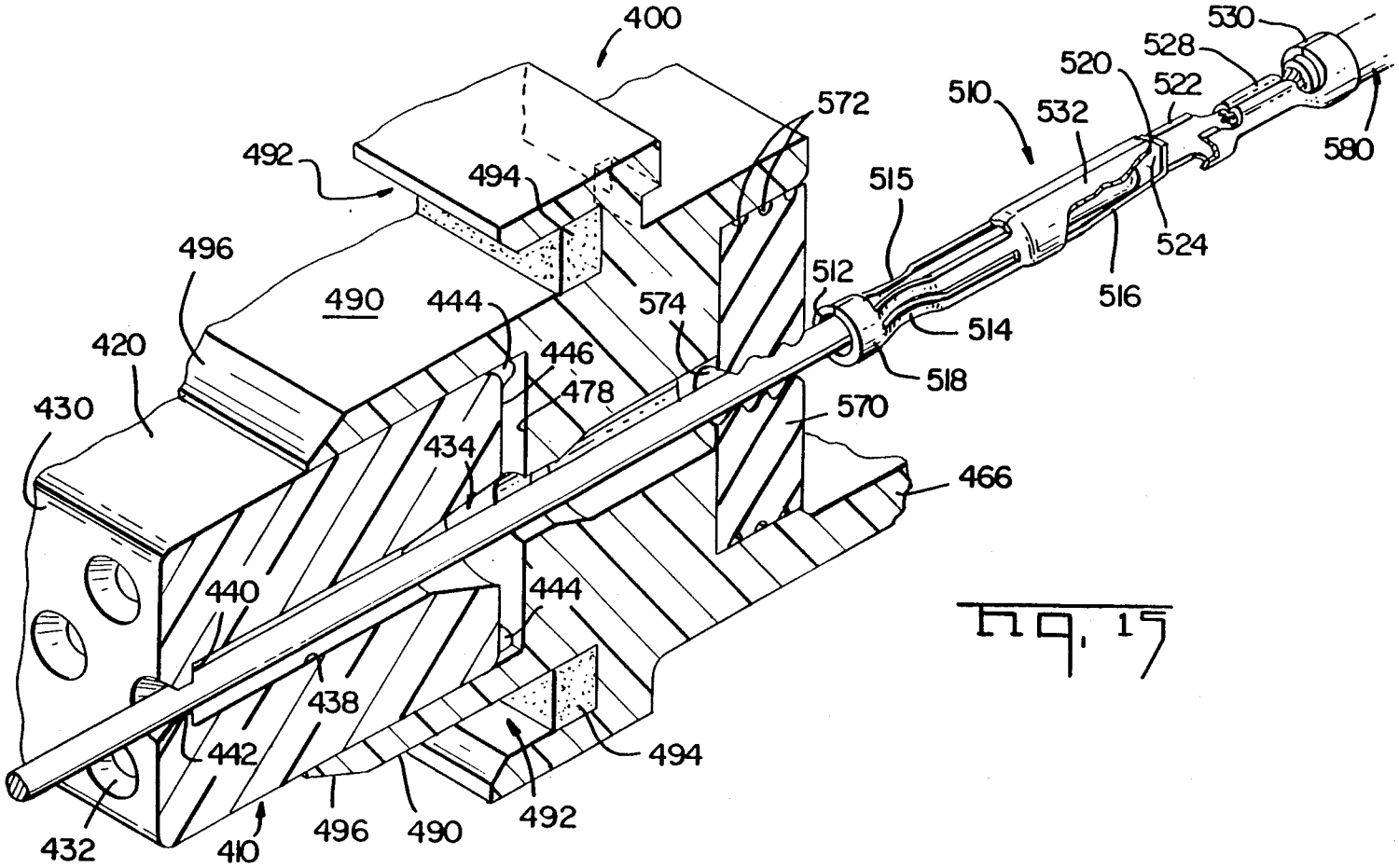
FIG. 15 shows a cutaway view of the assembled plug assembly and the insertion of the contact.

In order to install the contact 510 through the apertures in the rubber grommet, the lance end 520 should be enclosed within the envelope defined by the contact barrel portion 532 so as not to damage the grommet. As shown in FIG. 15, a pin, paper clip, or the like may be inserted in the pin-receiving area 512 and pushed rearwardly until the point of the pin contacts the lance 516 urging the lance end 520 downwardly through the lance opening 522 and into the envelope defined by the barrel portion 532. The contact 510, with the pin inserted, may then be placed through the grommet apertures 574 and through the contact receiving holes 434 in insert 410, as shown in FIG. 15. When the contact 510 is completely inserted, the socket end 518 abuts shoulder 440 in the insert 410. The pin which has been inserted in the contact 510 protrudes through the individual holes in the insert 410 and is now removed, which allows the lances to bias upwardly, placing the lance end 520 in the gap between the surface 446 of the insert and the surface 478 of the plug housing 460, as shown in FIG. 16. The contact is securely mounted within the insert and housing, as the contact end 518 abuts the respective shoulder 440 of the insert and the lance end 520 abuts the lance back stop 524 and the surface 478 of plug housing 460.

Once all the contacts are in place, the cover may be installed enclosing the rearward end of the plug housing 460, as best shown in FIG. 11. The latching tabs 542 may then be placed in respective slots (not shown) in the housing 460 and the latches 546 snapped over the mounting slots 464. A bundle tie 562 is then placed around the multiconductor cable and around the cover 540 and plug housing 460 providing for strain relief on the individual wires 580.

Although not part of the instant invention, the connector 2 and the printed circuit board 110 are mounted on a bulkhead 300, as shown in FIG. 1. The bulkhead 300, although shown as a wall, is actually one side of a box to be located locally for a system requiring the logic of circuitry. The actual method of mounting the connector 2 and the plug housing 460 on the bulkhead 300 is determined by the configuration of the mounting face. In the preferred embodiment, the front mating face 502 of the plug housing 460 is planar, as shown in FIG. 11, whereas, in an alternate embodiment, the front mating face 502 includes bosses 504A.

Figure 20A:
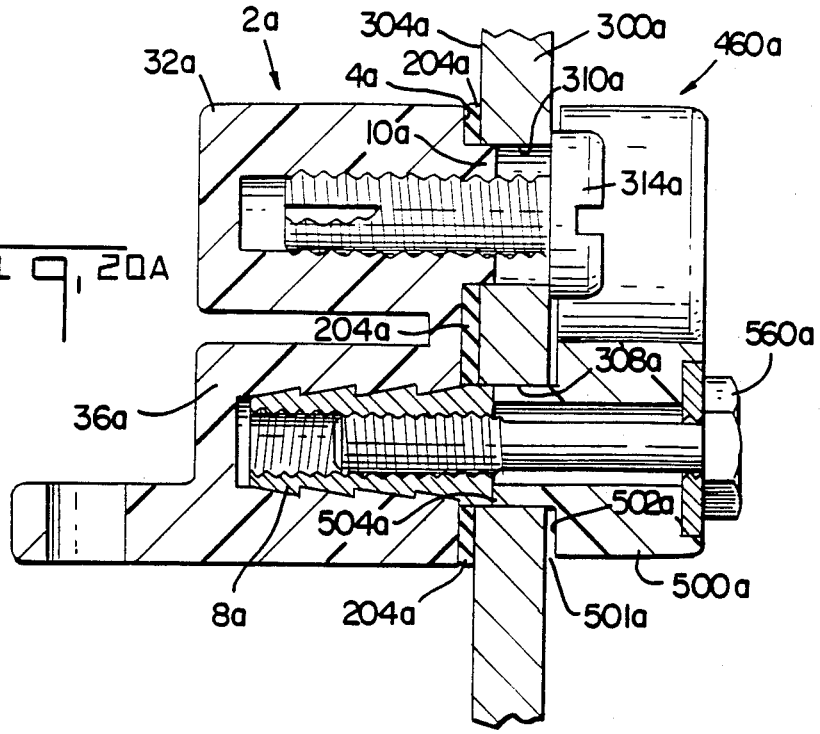
FIG. 20A shows a cross section of the alternate embodiment through the mounting holes of the receptacle and plug assembly.
Figure 20:
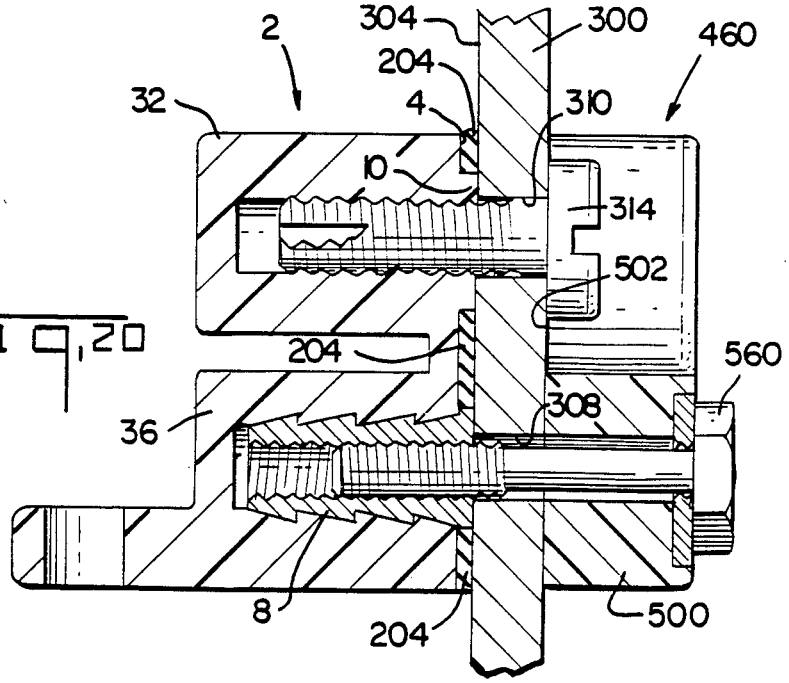
FIG. 20 shows a cross section of the preferred embodiment through the mounting holes of the receptacle and plug assembly.

When the mounting face 502 of the plug housing 460 is planar, the mounting face 502, will of course be mounted flushly with the bulkhead 300 outer surface, as shown in FIG. 20. The holes 308 and 310 in the bulkhead, aligned with the insert 8 and boss 10, respectively, are dimensioned to receive the respective screws only, that is, the holes are not dimensioned to receive the insert 8 and boss 10. Rather, the front face of the insert 8 and the boss 10 bears directly on the bulkhead 300 back surface 304. The heights of insert 8 and boss 10 are dimensioned so as to control the amount of gasket 204 squash, that is, the height of the insert 8 and boss 10 is smaller than the undeformed thickness of the gasket 204. When the connector 2 is mounted to the back side of the bulkhead 300 by means of the self tapping screws however, the connector 2 will pull up towards the bulkhead and the gasket 204 will deform to the extent of the interference between the insert 8 and boss 10 and the backside of the bulkhead 300, as best shown in FIG. 20. When the plug housing 460 is also attached to the bulkhead 300, the machine screws 560 are placed through the housing and threaded within the inserts 8. As the machine screws 560 are tightened within the inserts 8, the insert is brought up against the backside of the bulkhead 300, and the facial friction between the insert 8 and the bulkhead 300, prevents the insert from failing in a torsional mode, turning within the connector boss 36.

When the alternate embodiment is employed, as shown in FIG. 20A, the holes 308A and 310A within the bulkhead are dimensioned so as to receive the insert 8 and boss 10 therein, as shown in FIG. 20A. In this embodiment, the height of the insert 8A and boss 10A away from the face 4A, is greater than that in the preferred embodiment, as they extend into the respective holes 308A and 310A of the bulkhead 300. When the plug 460A is inserted into engagement with the connector 2, and the machine screws 540 A threaded into engagement with the inserts 8A, the bosses 504A are also brought into the hole 308A. Continued tightening of the machine screws 560A brings the faces of the bosses 504A to bear on the faces of the inserts 8A, leaving a gap 501A between the face 502A and the bulkhead 300A, as shown in FIG. 20A. In this case, as the screws 560A are tightened, the bosses 308A against the faces of the inserts 8A causes a frictional effect preventing the inserts 8A from failing by turning within the connector bosses 36A. A gap 501A exists between the mounting face 502A of the plug housing 460A and the bulkhead 300A.

Figure 17:
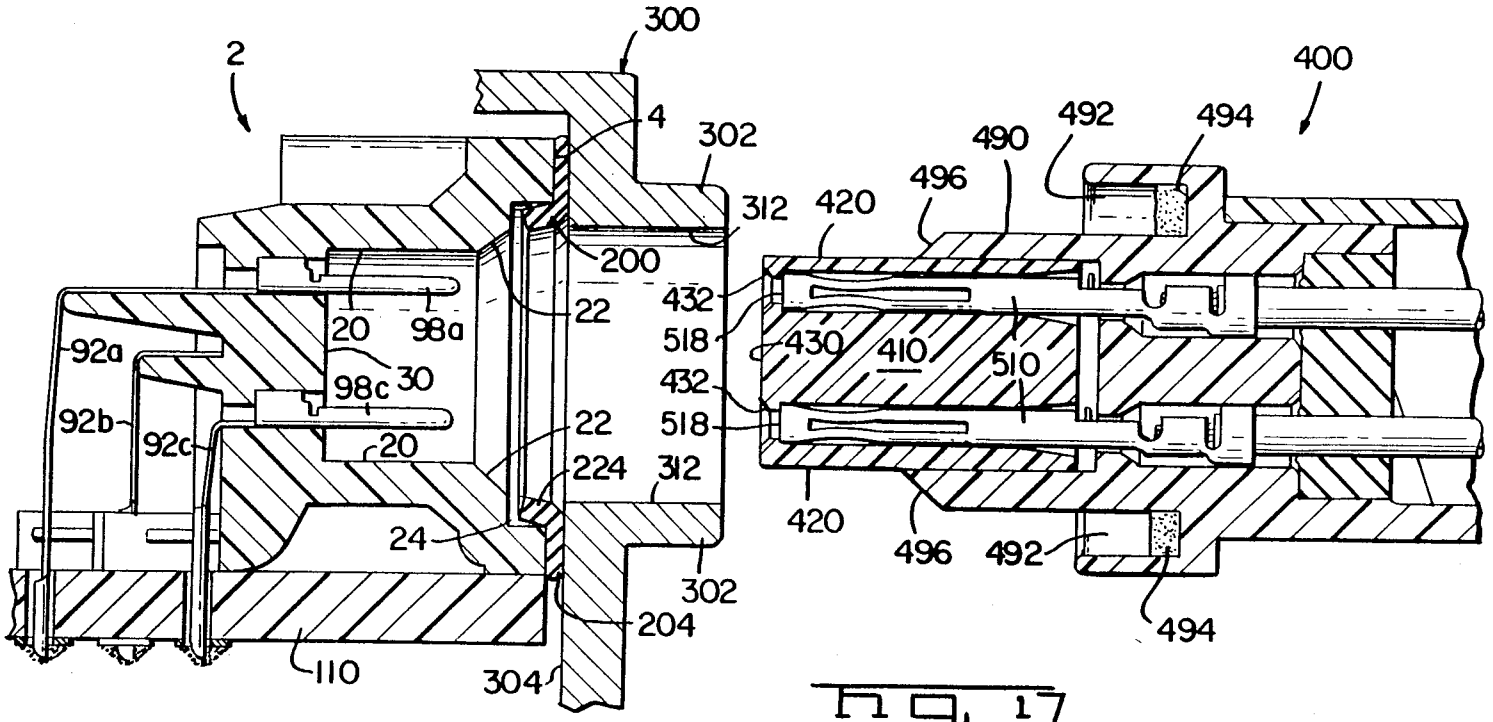
FIG. 17 is a cross-sectional view of the receptacle and the plug assembly through lines 8—8 of FIG. 1.
Figure 1:
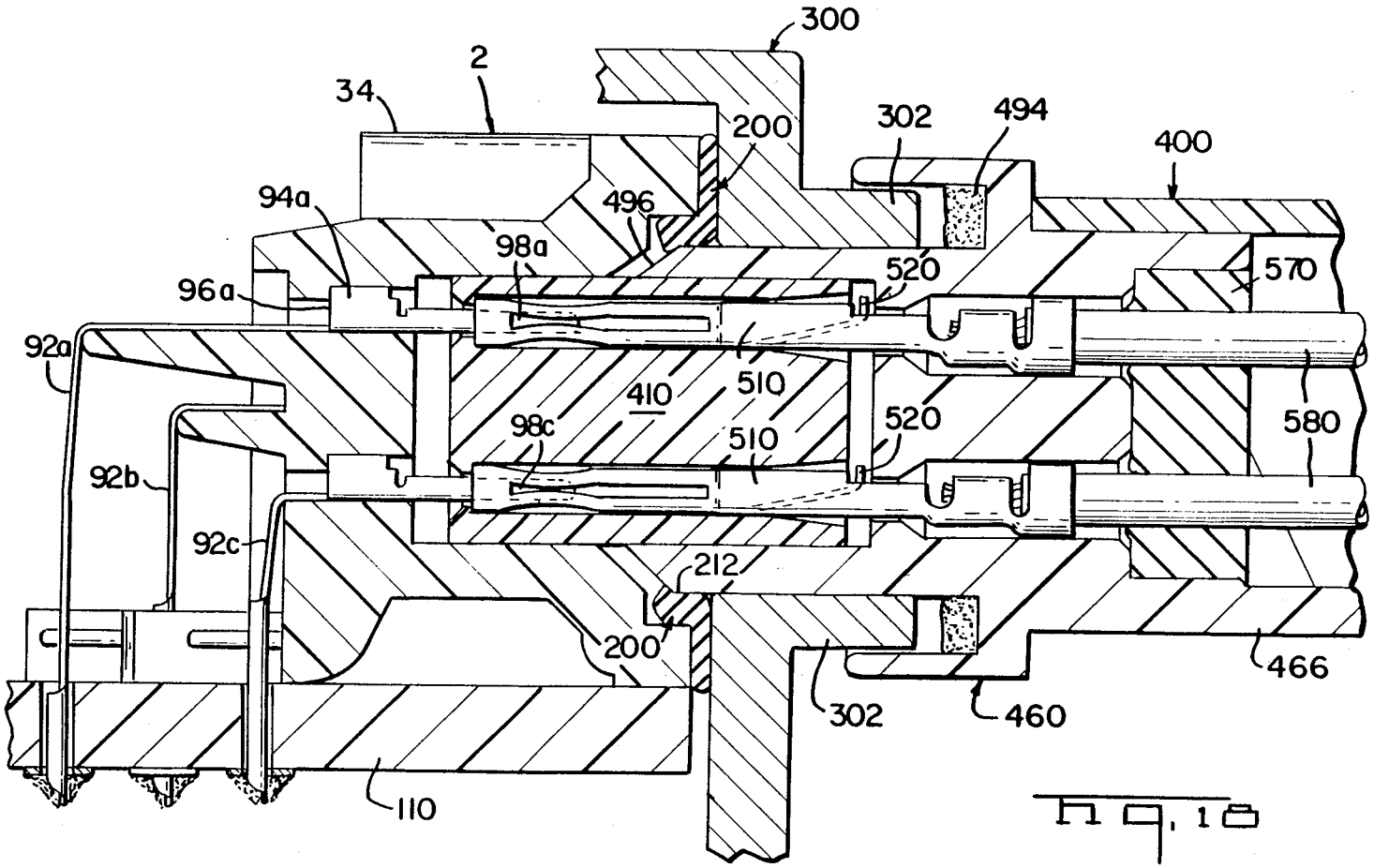

To seal the connector 2 and a printed circuit board 110 from any contaminants at the local interface, a seal 200 is placed between the bulkhead mounting face 304, the surface 204 of the seal abutting the mounting surface 304 of the bulkhead 300, as shown in FIG. 17. When the gasket 200 is placed onto the mating face 4 of the connector 2, the cylindrical portion 224 of the gasket extends into the gasket seal 24 of the connector 2. As the connector is drawn up to the bulkhead 300, by means of the self-tapping screws 314, the flat portion 204 of the gasket 200 undergoes a slight amount of crush between the surfaces 304 and 4, respectively.

Figure 19:
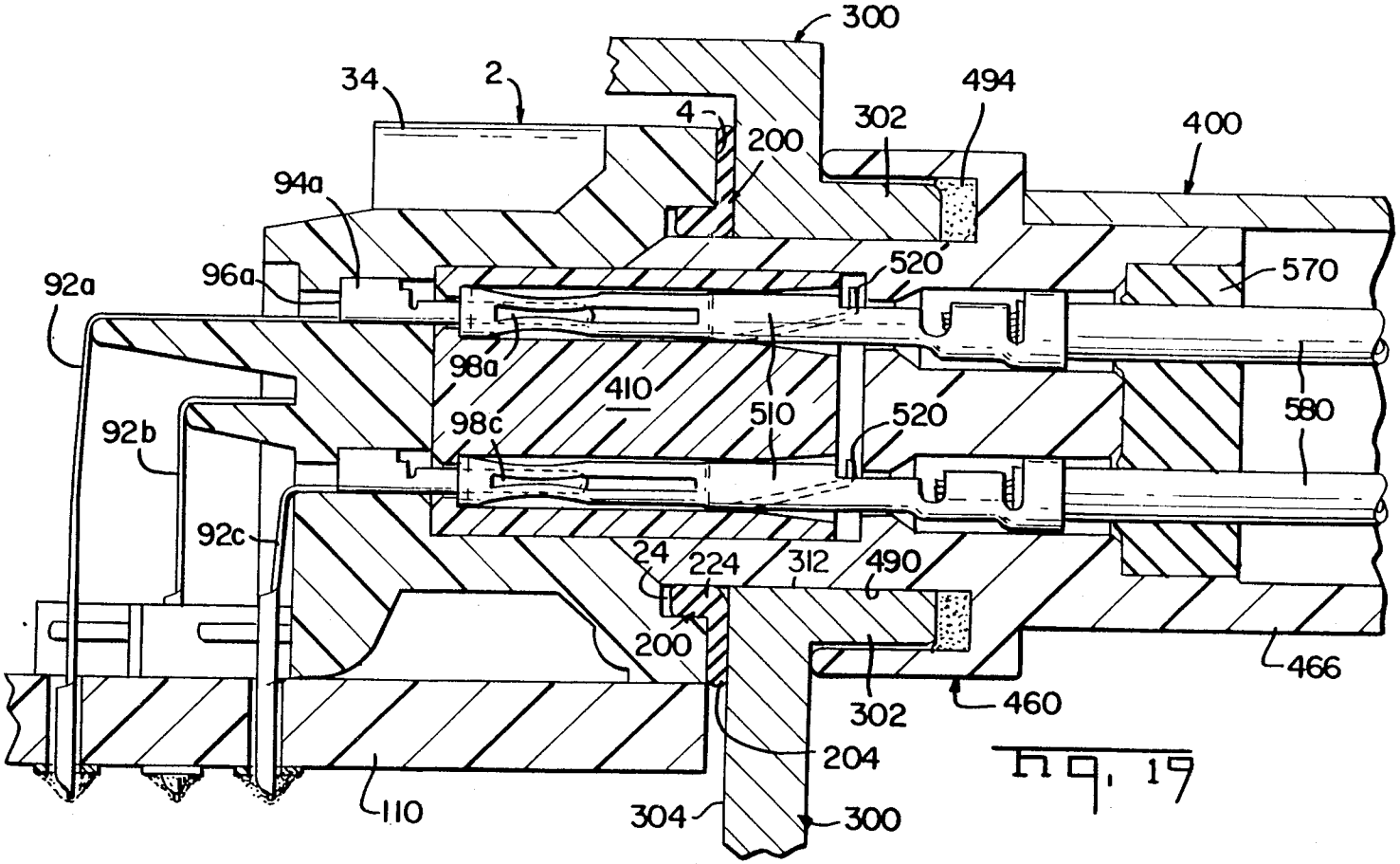
FIG. 19 shows the cross section of the preferred embodiment completely assembled.
Figure 17A:
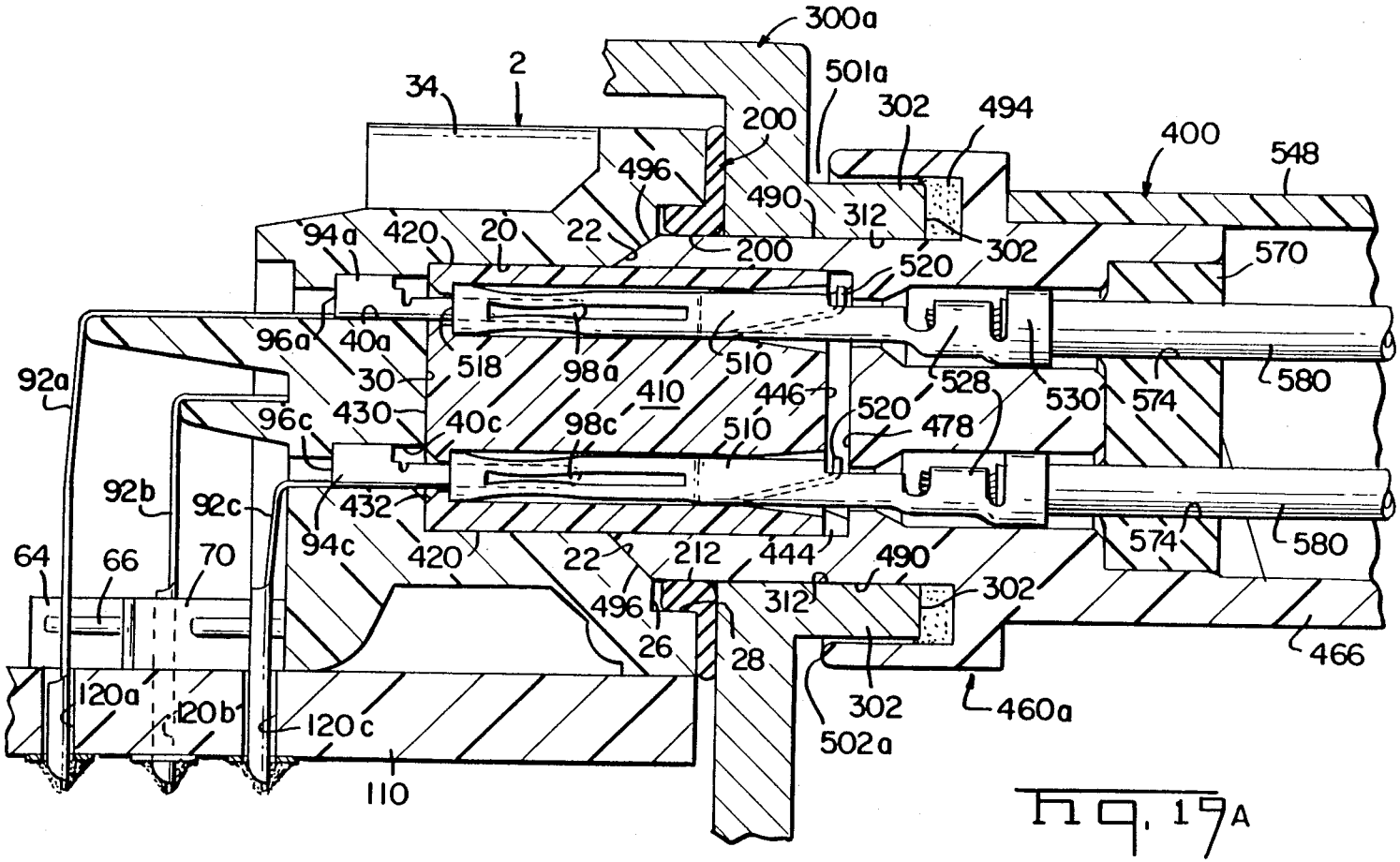

As best shown in FIG. 17, as the plug assembly 400 is brought forward into the plug cavity 18, the contacts 98 are aligned with the socket ends 518 by means of frustoconical lead-in sections 432. The peripheral surface 212 of the gasket 200 and the peripheral surface 490 of the plug 400 are dimensioned so as to create an interference fit between them, thus continued forward motion of the plug portion 400 results in contact between the lead-in surface 496 of the housing in the outer surface 212 of the gasket 200, as shown in FIG. 18. As the plug 400 continues inward, the lead-in portion 496 sequentially forces the surface 212 of the O-ring portion 224 radially outward, as shown in FIG. 18, which ultimately results in the surface 212 being planar or continuous with surface 312 and with surface 490, as shown in FIG. 19. When completely inserted, the front surface 430 of the insert 410 abuts back surface 30 of the cavity 18, and lead-in section 496 of the plug 400 abuts the lead-in section 22 of the connector 2 as shown in FIGS. 17 and 19. When the machines screws 560 (FIG. 1) are threaded into the inserts 8, and the plug 400 is drawn up to the bulkhead 300, the peripheral groove 492 extends over the flange 302, the forward surface of flange 302 abutting and squashing the seal 494 as shown in FIG. 19, providing a seal between the local environment and the socket contacts 510.

In the preferred embodiment, when the plug 400 is drawn up to the bulkhead 300, the mounting face 502 is mounted flush with the face of the bulkhead, as shown in FIG. 19. When the alternate embodiment is used, as shown in FIG. 19A, a gap 501A exists between the mounting face 502A of the plug housing 460A and the bulkhead 300A.

When the plug portion is fully mated with the header, as shown in FIG. 19 or 19A, the pin contacts 98, are fully inserted in the constricted portion 514 of socket contact 510. As assembled the unit provides an exceptional vibration resistant plug and header combination. As designed the socket contact 510 utilizes four resilient beam sections 515 inwardly biased between two band sections, the forward contact portion 518 and the contact barrel portion 532. Because the beam sections 515 are held at each end by the band portions, the beam sections cannot vibrate away from the pin causing an electrical discontinuity. Also, as the straight section of 438 of the insert 410 is closely toleranced to only allow a sliding fit of the contact front portion 518 and contact barrel portion 532, the contact 510 cannot unroll, causing a discontinuity between the pin portion 90 and the individual resilient beam sections of the constricted portion 514. Therefore, the socket contacts exhibit superior vibration resistance when utilized in a high vibration environment. Vibration can be excited in any plane of the contact or pin without causing either to vibrate thereby effecting an open circuit.

Samples of the embodiment of FIG. 20A were subjected to vibrational tests which include applying a current of 100 milliamperes through each contact of the plug 400 and receptacle 2, and then subjected to random vibrational excitations of between 0–2000 hertz. The test monitored the plug and receptacle current for discontinuities greater than one micro-second. During a 20-hour test for this embodiment, the connector system was able to withstand average accelerations of 27 times the normal earth's gravity through the entire frequency range from 0 to 2000 Hz, and no discontinuities in current were found, nor was physical damage experienced by the monitored samples. It is believed that the embodiment of FIG. 20 would perform with similar success when subjected to the same test.

It is important that in each of the embodiments that the plug 400 and receptacle 2 vibrate as a unit. In the preferred embodiment the plug 400 and receptacle 2 vibrate as a unit solidly affixed to the bulkhead 300, whereas in the alternate embodiment the plug 400 and receptacle 2 vibrate with the bulkhead 300, but buffered through the seal 200.

In the preferred embodiment as shown in FIG. 20, the receptacle 2 is first mounted to the backside 304 of the bulkhead 300, the front faces of the inserts 8 and bosses 10 directly abutting the bulkhead 300. When the plug 400 is inserted and the screws 560 torqued down, surfacd 502 of the plug 400 is also directly abutting the bulkhead 300, therefore, the plug 400 and receptacle 2 vibrate directly with the bulkhead.

In the alternate embodiment, as shown in FIG. 20A, the insert 8A and the bosses 10A are dimensioned to be received in the bulkhead mounting holes 308A and 310A, respectively. When the self-tapping screws 314A are drawn up to hold the receptacle in place, the seal is somewhat squashed and the insert 8A and bosses 10A may travel within the respective holes 308A and 310A. When the plug 400A is mated to the receptacle 2A and the machine screws installed, the bosses 504A extending from the plug mating face 502A abut the inserts 8A prior to the mating face 502A contacting the bulkhead, leaving a gap 501A between the mating face 502A of the plug 400 and the bulkhead 300. Thus, the receptacle 2 and plug 400 are solidly affixed to one another but only contact the bulkhead 300 through the seal 200 which buffers vibration from the bulkhead to the receptacle-plug assembly.

Furthermore, in either the preferred or alternate embodiment, the gasket 200 between the connector 2 and the bulkhead; the seal 474 between plug housing 460 and the bulkhead flange 302; the seal 570 within the plug housing 460; and the bundle tie 562 around the multi-conductor bundle of wires, all help to reduce the vibration from the bulkhead 300 to the socket contacts 98.

The instant invention of either embodiment relates to a plug-receptacle assembly for mounting in a high vibration environment, such as in automotive use, and each individual wire can carry up to 6 amps of current without interruption from the vibration. Although the preferred embodiment of the receptacle contains 28 contacts which would allow a total current of 168 amps, it should be understood that the connector could include any number of contacts.

What is claimed is:

1. A vibration resistant connector assembly for interconnecting a plurality of conductors, the assembly being mountable to a bulkhead wall having an opening therethrough, the bulkhead wall having a plurality of receptacle mounting apertures and plug mounting apertures therethrough, the assembly comprising:

a receptacle including a housing having a mating face and a receiving cavity extending inwardly from the mating face to a back wall with a plurality of pin terminals extending from the back wall into the receiving cavity, the mating face including receptacle mounting means alignable with said receptacle mounting apertures and plug mounting means alignable with said plug mounting apertures;

a gasket locatable between said bulkhead wall and said mating face of said receptacle, the gasket having a cutout portion profiled as the opening in said bulkhead wall;

a plug member having a plurality of socket contacts mounted therein, the plug member including a forward portion profiled to be received through said opening in said bulkhead wall and into said receptacle, the forward portion including apertures in communication with the socket contacts and aligned as said pin terminals, and a flange means extending around the plug member having holes alignable with the plug mounting apertures;

fastener means extendable through the receptacle mounting apertures and into the receptacle mounting means for fastening said receptacle against said gasket and to said bulkhead wall; and fastener means extendable through the holes in the plug member, through the plug mounting apertures in the bulkhead wall, and into the plug mounting means for fastening said receptacle and plug member together.

2. The assembly of claim 1 wherein said receptacle mounting means comprises holes extending into the mating face of the receptacle and bosses surrounding said holes in the mating face of the receptacle projecting away from the mating face.

3. The assembly of claim 2 wherein the plug mounting means comprises threaded inserts located in the mating face of said receptacle.

4. The assembly of claim 3 wherein the bosses of the receptacle mating face and the threaded inserts are profiled to be received in the respective receptacle and plug mounting apertures.

5. The assembly of claim 4 wherein the flange means includes bosses extending therefrom, surrounding the holes in the flange means, profiled to be received in said plug mounting apertures to abut the threaded inserts extending from the mating face of the receptacle and to space the plug flange means away from the bulkhead wall.

6. The assembly of claim 3 wherein the bosses and the inserts include faces equidistant from the mating face and are profiled to abut the bulkhead wall overlying the receptacle and plug mounting apertures.

7. An assembly including a receptacle and plug means for electrically interconnecting a plurality of conductors, the receptacle and plug means being mountable to opposite sides of a bulkhead wall having an opening therethrough, the assembly being useable in high vibration atmospheres without electrical discontinuity, the assembly comprising:

a receptacle including a housing having a mating face and a receiving cavity extending inwardly from the mating face to a back wall, the receiving cavity for aligning with the opening in the bulkhead wall, the back wall having a plurality of apertures extending therethrough with a plurality of pin terminals disposed in the apertures, the pin terminals having mating portions extending forwardly from the back wall, the pin terminals including means for interconnection to a first plurality of conductors;

a plug means having a forward portion profiled to be received through the opening in the bulkhead wall and into the receiving cavity, the forward portion having a front mating face being profiled for contact with the back wall of the receiving cavity such that the receptacle and plug means can vibrate as a unit, the forward portion of the plug means having apertures extending therein in alignment with the pin terminals, and a plurality of socket contact means mounted in the apertures of the plug means, the socket conatct means comprising forward closed barrel portions, intermediate constricted portions and rearward closed barrel portions, the constricted portions profiled to bias against the pin terminals upon insertion to resist vibration in any excited plane to prevent current discontinuity;

means for mounting the receptacle to the bulkhead wall; and means cooperatively provided by said receptacle and plug means for securing the receptacle and plug means together.

8. The assembly of claim 7, wherein the constricted portions comprise resilient beams extending between the forwrad closed barrel portions and the rearward closed barrel portions, biased inwardly towards the axial centerline of the socket contact means.

9. The assembly of claim 7 wherein the receptacle mounting means comprises apertures in the mating face for alignment with first holes in the bulkhead wall, and fastener means for extending through the first holes of the bulkhead wall and into the apertures in the mating face of the receptacle.

10. The assembly of claim 9 wherein first bosses extend around the apertures in the receptacle mating face.

11. The assembly of claim 10 wherein the first bosses include a face profiled for abutting the bulkhead wall.

12. The assembly of claim 10 wherein the first bosses are profiled for receipt into the first holes of the bulkhead wall.

13. The assembly of claim 10 wherein the securing means comprises threaded inserts mounted in the face of the receptacle alignable with second holes in the bulkhead wall, and the plug means comprises a flange extending therearound having apertures in alignment with the second holes in the bulkhead wall and with the threaded inserts, for receiving a bolt into the threaded inserts.

14. The assembly of claim 13 wherein the apertures in the flange include second bosses therearound.

15. The assembly of claim 14 wherein the inserts and the second bosses are profiled for receipt within the second holes such that the inserts and the second bosses are in an abutting relationship spacing the plug means away from the bulkhead wall.

16. The assembly of claim 14 wherein the inserts are each profiled for abutting the bulkhead wall.

17. The assembly of claim 7 further comprising a facial seal member disposable between the mating face of the receptacle and a receptacle receiving side of the bulkhead wall.

18. The assembly of claim 14 further comprising a facial seal member disposable between the mating face of the receptacle and a receptacle receiving said of the bulkhead wall, the seal being profiled to receive the first bosses therethrough.

19. A receptacle and plug assembly for electrically interconnecting a plurality of conductors, the receptacle and plug mountable to opposite sides of the bulkhead wall having an opening therethrough, the assembly useable in a high vibration atmosphere without electrical discontinuity, the assembly comprising:

a receptacle including a housing having a mating face and a receiving cavity extending inwardly from the mating face to a back wall, the receiving cavity for aligning with the opening in the bulkhead wall, the back wall having a plurality of apertures extending therethrough with a plurality of pin terminals disposed in the apertures, the pin terminals having a mating portion extending forward of the back wall, the pin terminals including means for interconnection to a first plurality of conductors, the receptacle comprising mounting means for mounting the receptacle to the bulkhead wall;

a plug including a housing member and an insert member, the housing member having a contact receiving face and an insert receiving face, and a wall extending outward of the insert receiving face defining an insert receiving cavity, the housing member having a plurality of apertures extending between the contact receiving face and the insert receiving face, an insert positioned within said insert receiving cavity having a forward mating surface and a plurality of apertures extending from the forward mating surface through the insert, aligned with the apertures in the housing member, and a plurality of contacts fixedly mounted within the apertures of the insert and plug housing member, and means for securing said receptacle and plug together causing the forward mating surface of the insert to abut the back wall of the receptacle, allowing the receptacle and plug to vibrate as a unit.

20. The assembly of claim 19 wherein the contacts comprise forward cylindrical portions, intermediate constricted portions and barrel portions.

21. The assembly of claim 20 wherein the apertures within the insert include rearwardly facing shoulders, and the forward cylindrical portions are positioned against said rearwardly facing shoulders in an abutting relationship.

* * * * *